US010303070B2

(12) United States Patent
Fukuma

(10) Patent No.: US 10,303,070 B2
(45) Date of Patent: May 28, 2019

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Michinori Fukuma, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/818,759

(22) Filed: Nov. 21, 2017

(65) Prior Publication Data

US 2018/0210355 A1 Jul. 26, 2018

(30) Foreign Application Priority Data

Jan. 24, 2017 (JP) ..... 2017-010469

(51) Int. Cl.

| | |
|---|---|
| ***G03G 5/06*** | (2006.01) |
| ***G03G 5/047*** | (2006.01) |
| *G03G 15/00* | (2006.01) |

(52) U.S. Cl.

CPC ..... *G03G 5/0614* (2013.01); *G03G 5/047* (2013.01); *G03G 5/0672* (2013.01); *G03G 15/75* (2013.01)

(58) Field of Classification Search

CPC ..... G03G 5/0614; G03G 5/047
USPC ..... 430/58.75, 58.85, 58.65, 58.8
See application file for complete search history.

(56) References Cited

U.S. PATENT DOCUMENTS

| | | | | |
|---|---|---|---|---|
| 5,342,719 | A * | 8/1994 | Pai | G03G 5/0614 430/58.8 |
| 5,430,526 | A * | 7/1995 | Ohkubo | G03G 15/0233 399/159 |
| 6,811,940 | B2 | 11/2004 | Kita et al. | |
| 8,524,428 | B2 * | 9/2013 | Nakamura | G03G 5/0614 430/58.5 |
| 2009/0325096 | A1 * | 12/2009 | Wu | G03G 5/0535 430/58.85 |
| 2014/0045107 | A1 | 2/2014 | Vella et al. | |

FOREIGN PATENT DOCUMENTS

| | | |
|---|---|---|
| JP | 2003-089681 | 3/2003 |
| JP | 2014-038325 | 2/2014 |

* cited by examiner

*Primary Examiner* — Janis L Dote
(74) *Attorney, Agent, or Firm* — JCIPRNET

(57) ABSTRACT

An electrophotographic photoreceptor includes a conductive substrate and a photosensitive layer disposed so as to overlie the conductive substrate and containing a first charge-transporting material having two triphenylamine skeletons and a charge mobility of approximately $4\times10^{-6}$ $cm^2/Vs$ or more and at least one second charge-transporting material selected from the group consisting of a charge-transporting material having one triphenylamine skeleton and a charge mobility of approximately $5\times10^{-5}$ $cm^2/Vs$ or more, a charge-transporting material having two triphenylamine skeletons and being different from the first charge-transporting material, and a charge-transporting material having three triphenylamine skeletons, wherein the second charge-transporting material content is approximately from 0.2 weight % to 1.0 weight % relative to the total charge-transporting material content.

9 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2017-010469 filed Jan. 24, 2017.

BACKGROUND

(i) Technical Field

The present invention relates to an electrophotographic photoreceptor, a process cartridge, and an image forming apparatus.

(ii) Related Art

In well-known typical electrophotographic image forming apparatuses, an electrophotographic photoreceptor (also referred to as "photoreceptor") is used; and processes of charging, forming an electrostatic latent image, development, transfer, and cleaning are performed in sequence.

Known electrophotographic photoreceptors are functionally-separated photoreceptors in which a charge-generating layer and a charge-transporting layer are laminated so as to overlie a conductive substrate, such as an aluminum substrate, and single-layer photoreceptors in which a single layer serves to generate charges and to transport the charges.

SUMMARY

According to an aspect of the invention, there is provided an electrophotographic photoreceptor including a conductive substrate and a photosensitive layer disposed so as to overlie the conductive substrate and containing a first charge-transporting material having two triphenylamine skeletons and a charge mobility of approximately $4\times10^{-6}$ $cm^2/Vs$ or more and at least one second charge-transporting material selected from the group consisting of a charge-transporting material having one triphenylamine skeleton and a charge mobility of approximately $5\times10^{-5}$ $cm^2/Vs$ or more, a charge-transporting material having two triphenylamine skeletons and being different from the first charge-transporting material, and a charge-transporting material having three triphenylamine skeletons, wherein the second charge-transporting material content is approximately from 0.2 weight % to 1.0 weight % relative to the total charge-transporting material content.

BRIEF DESCRIPTION OF THE DRAWINGS

Exemplary embodiments of the present invention will be described in detail based on the following figures, wherein.

DETAILED DESCRIPTION

Figure 1:
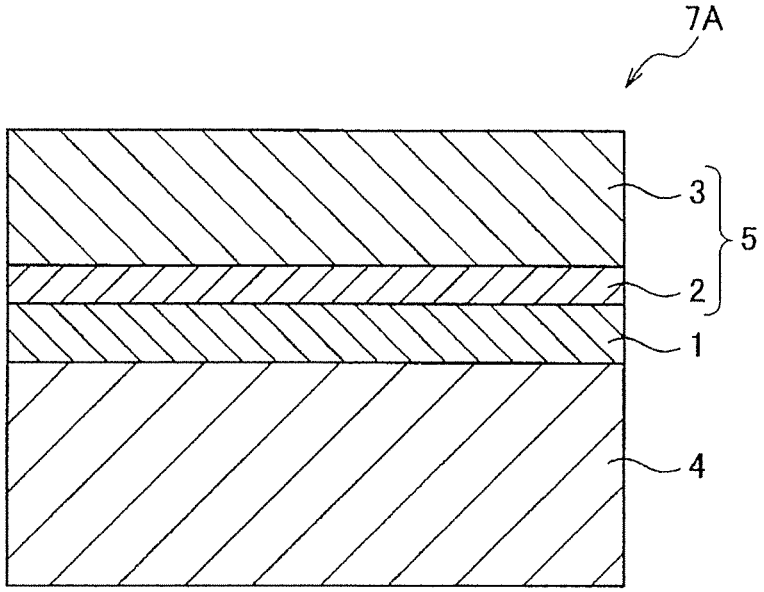
FIG. 1 is a schematic cross-sectional view partially illustrating an example of the layered structure of an electrophotographic photoreceptor according to a first exemplary embodiment.

An electrophotographic photoreceptor according to a first exemplary embodiment includes a conductive substrate and a photosensitive layer disposed so as to overlie the conductive substrate. The photosensitive layer contains a first charge-transporting material having two triphenylamine skeletons and a charge mobility of approximately $4\times10^{-6}$ $cm^2/Vs$ or more (also simply referred to as "first charge-transporting material") and at least one second charge-transporting material selected from the group consisting of a charge-transporting material having one triphenylamine skeleton and a charge mobility of approximately $5\times10^{-5}$ $cm^2/Vs$ or more, a charge-transporting material having two triphenylamine skeletons and being different from the first charge-transporting material, and a charge-transporting material having three triphenylamine skeletons (also simply referred to as "second charge-transporting material"). The second charge-transporting material content is approximately from 0.2 weight % to 1.0 weight % relative to the total charge-transporting material content.

The expression "having one triphenylamine skeleton" herein refers to having one skeleton represented by $N(C_6H_5)_3$. The expression "having two triphenylamine skeletons" herein refers to having two skeletons represented by $N(C_6H_5)_3$, and the expression "having three triphenylamine skeletons" herein refers to having three skeletons represented by $N(C_6H_5)_3$. In the case where the molecular structure has two or three triphenylamine skeletons, two or three amino groups having two phenyl rings may be substituted on one benzene ring.

In the photosensitive layers of typical electrophotographic photoreceptors, for example, a charge-transporting material having two triphenylamine skeletons is used. The charge-transporting material having two triphenylamine skeletons can be a material that is well capable of transporting charges (for instance, a charge mobility of approximately $4\times10^{-6}$ $cm^2/Vs$ or more) in some cases. An example of a material that can be used as the charge-transporting material having two triphenylamine skeletons and a charge mobility of approximately $4\times10^{-6}$ $cm^2/Vs$ or more is N,N'-diphenyl-N,N'-bis(3-methylphenyl)-1,1'-biphenyl-4,4'-diamine.

Use of N,N'-diphenyl-N,N'-bis(3-methylphenyl)-1,1'-biphenyl-4,4'-diamine as an example of the charge-transporting material having two triphenylamine skeletons and a charge mobility of approximately $4\times10^{-6}$ $cm^2/Vs$ or more will now be described.

N,N'-diphenyl-N,N'-bis(3-methylphenyl)-1,1'-biphenyl-4,4'-diamine is known as a material that is not only well capable of transporting charges but is also less likely to suffer crystallization as compared with other charge-transporting materials having two triphenylamine skeletons.

In the case where only N,N'-diphenyl-N,N'-bis(3-methylphenyl)-1,1'-biphenyl-4,4'-diamine is used as a charge-transporting material in a photosensitive layer, however, the charge-transporting material is crystallized in the photosensitive layer in some cases, which may impair electrical properties. An image formed with a photoreceptor with impaired electrical properties may suffer, for example, the occurrence of color spots in some cases.

The cause of the occurrence of the crystallization of the charge-transporting material in the photosensitive layer is believed to be as follows.

N,N'-diphenyl-N,N'-bis(3-methylphenyl)-1,1'-biphenyl-4,4'-diamine is less soluble in a solvent (for example, tetrahydrofuran), and the coarse particles thereof are therefore not completely dissolved and remain in the solvent in some cases. It is presumed that such residual coarse particles of the charge-transporting material serve as the cores of crystal and cause crystallization of the charge-transporting material. Hence, an additional process of removing the coarse particles of the charge-transporting material with a filter is necessary.

After a coating liquid for forming a photosensitive layer, which has been subjected to the removal of the coarse particles with a filter, is applied, the solvent used in the coating liquid volatilizes; at this time of volatilization, latent heat of vaporization from the solvent easily causes the charge-transporting material dissolved in a nearly saturated state to agglomerate into crystal. Particularly in the case where the photosensitive layer is thick, the crystallization of the charge-transporting material readily occurs.

Accordingly, a photosensitive layer in which only N,N'-diphenyl-N,N'-bis(3-methylphenyl)-1,1'-biphenyl-4,4'-diamine is used as a charge-transporting material may suffer from the crystallization of the charge-transporting material in some cases even though the coarse particles thereof are removed with a filter.

In the electrophotographic photoreceptor of the first exemplary embodiment, the crystallization of the charge-transporting materials that are used in the photosensitive layer as described above is reduced, and thus impairment of electrical properties is reduced. The mechanism thereof has been still studied but can be presumed to be as follows.

Since the charge-transporting materials are used in combination as described above in the electrophotographic photoreceptor of the first exemplary embodiment, the concentration of the first charge-transporting material in the whole charge-transporting material becomes low, which leads to a reduction in the agglomeration of the whole charge-transporting material. The combined use of the charge-transporting materials in the manner described above enables the molecular structure of the whole charge-transporting material to be less symmetrical, so that the agglomeration of the whole charge-transporting material is reduced. It is believed that this mechanism contributes to a reduction in the crystallization of the charge-transporting materials.

In the case where the second charge-transporting material used in combination with the first charge-transporting material is a charge-transporting material having one triphenylamine skeleton and a charge mobility of approximately $5\times10^{-5}$ $cm^2/Vs$ or more, the charge mobility of approximately $5\times10^{-5}$ $cm^2/Vs$ or more enables charges to be less likely to be trapped, which leads to a reduction in impairment of electrical properties. Furthermore, a decrease in the number of hopping sites, which is brought about by phenyl groups, is reduced between the first charge-transporting material and such a second charge-transporting material. It is believed that such a mechanism enables a reduction in the capability of transporting charges to be suppressed with the result that impairment of electrical properties is reduced.

In the case where the second charge-transporting material used in combination with the first charge-transporting material is at least one selected from a charge-transporting material having two triphenylamine skeletons and being different from the first charge-transporting material and a charge-transporting material having three triphenylamine skeletons, a structure in which amine moieties of the first and second charge-transporting materials face each other is formed in the photosensitive layer, and thus nitrogen atoms are positioned close to each other. It is believed that this structure enables a reduction in the capability of transporting charges to be suppressed with the result that impairment of electrical properties is reduced.

In the case where a charge-transporting material that has one triphenylamine skeleton but has a charge mobility of less than $4\times10^{-6}$ $cm^2/Vs$ and that is therefore less likely to form a structure of amine moieties facing each other, such as N,N-bis(3,4-dimethylphenyl)-4-biphenylamine, is used in combination, the capability of transporting charges is likely to be reduced. Hence, as compared with such a combined use of charge-transporting materials, the combined use of the first charge-transporting material and the second charge-transporting material in the electrophotographic photoreceptor of the first exemplary embodiment is believed to suppress a reduction in the capability of transporting charges.

In the case where at least one selected from a charge-transporting material having two triphenylamine skeletons and being different from the first charge-transporting material and a charge-transporting material having tree triphenylamine skeletons is used as the second charge-transporting material in a large amount (greater than 1.0 weight % relative to the total charge-transporting material content) to reduce crystallization, for example, charges are trapped in the photosensitive layer, which results in easy impairment of electrical properties.

Accordingly, in the electrophotographic photoreceptor of the first exemplary embodiment, it is speculated that the above-mentioned mechanisms enable reductions in the crystallization of the charge-transporting materials and in impairment of electrical properties.

In the electrophotographic photoreceptor of the first exemplary embodiment, trapping of charges is reduced in the photosensitive layer owing to the above-mentioned mechanisms, and impairment of electrical properties is therefore reduced. Hence, for instance, the occurrence of ghosts (a phenomenon in which a previously formed image appears on an image to be subsequently formed), image-burn in (a phenomenon in which image density increases in a region continuously exposed to light), and light fatigue (a phenomenon in which image density increases in a region exposed to light) is likely to be reduced as well.

Although an example in which N,N'-diphenyl-N,N'-bis(3-methylphenyl)-1,1'-biphenyl-4,4'-diamine is used as the first charge-transporting material has been described, using another material as the first charge-transporting material also enables reductions in the crystallization of the charge-transporting material in the photosensitive layer and in impairment of electrical properties.

The electrophotographic photoreceptor of the first exemplary embodiment will now be described with reference to the drawings.

FIG. 1 is a schematic cross-sectional view partially illustrating an example of the layered structure of an electrophotographic photoreceptor 7A according to the first exemplary embodiment. The electrophotographic photoreceptor 7A illustrated in FIG. 1 has a structure in which an undercoat layer 1, a charge-generating layer 2, and a charge-transporting layer 3 are overlying a conductive substrate 4 in sequence. The charge-generating layer 2 and the charge-transporting layer 3 serve as a photosensitive layer 5.

The electrophotographic photoreceptor 7A may have a structure in which the undercoat layer 1 is not provided. The electrophotographic photoreceptor 7A may have a structure in which a protective layer is additionally disposed on the charge-transporting layer 3. The electrophotographic photoreceptor 7A may have a single-layer photosensitive layer in which the charge-generating layer 2 and the charge-transporting layer 3 are functionally integrated.

Each layer of the electrophotographic photoreceptor of the first exemplary embodiment will now be described in detail. Reference signs are omitted for the sake of convenience.

Conductive Substrate

Examples of the conductive substrate include metal plates, metal drums, and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

In the case where the electrophotographic photoreceptor is used in a laser printer, the surface of the conductive substrate is suitably roughened to a center line average roughness Ra ranging from 0.04 μm to 0.5 μm in order to reduce interference fringes generated on radiation of laser light. The roughening for the reduction in interference fringes does not need to be performed when incoherent light is emitted from a light source; however, roughening the surface of the conductive substrate reduces generation of the defect thereof, which leads to prolonged product lifetime.

Examples of a technique for the roughening include wet honing in which an abrasive is suspended in water and then sprayed to the conductive substrate, centerless grinding in which a rotating grindstone is pressed against the conductive substrate to continuously grind it, and anodic oxidation.

Another roughening technique may be used; for instance, conductive or semi-conductive powder is dispersed in resin, the layer thereof is formed on the surface of the conductive substrate, and the particles dispersed in the layer serve for the roughening without directly roughening the surface of the conductive substrate.

In the roughening by anodic oxidation, a conductive substrate formed of metal (e.g., aluminum) serves as an anode for the anodic oxidation in an electrolyte solution, thereby forming an oxidation film on the surface of the conductive substrate. Examples of the electrolyte solution include a sulfuric acid solution and an oxalic acid solution. A porous anodic oxidation film formed by anodic oxidation is, however, chemically active in its original state; thus, it is easily contaminated and suffers a great change in resistance depending on environment. Accordingly, the pores of the porous anodic oxidation film are suitably closed owing to volume expansion resulting from a hydration reaction in pressurized steam or in boiled water (metal salt such as nickel is optionally added) to turn the oxidation film to more stable hydrous oxide.

The thickness of the anodic oxidation film is, for example, suitably from 0.3 μm to μ15 m. At a thickness in such a range, barrier properties to injection are likely to be given, and an increase in the residual potential due to repeated use is likely to be reduced.

The conductive substrate is optionally subjected to a treatment with an acidic treatment liquid or a boehmite treatment.

An example of the treatment with an acidic treatment liquid is as follows. An acidic treatment liquid containing a phosphoric acid, a chromic acid, and a hydrofluoric acid is prepared. The amounts of the phosphoric acid, chromic acid, and hydrofluoric acid in the acidic treatment liquid are, for instance, in the range of 10 weight % to 11 weight %, 3 weight % to 5 weight %, and 0.5 weight % to 2 weight %, respectively; the total concentration of the whole acid is suitably from 13.5 weight % to 18 weight %. The treatment temperature is, for example, suitably in the range of 42° C. to 48° C. The thickness of the coating film is suitably from 0.3 μm to 15 μm.

The boehmite treatment, for instance, involves a soak in pure water at a temperature ranging from 90° C. to 100° C. for 5 to 60 minutes or contact with heated steam at a temperature ranging from 90° C. to 120° C. for 5 to 60 minutes. The thickness of the coating film is suitably from 0.1 μm to 5 μm. The coating film is optionally further subjected to an anodic oxidation treatment with an electrolyte solution that less dissolves the coating film, such as adipic acid, boric acid, borate, phosphate, phthalate, maleate, benzoate, tartrate, or citrate.

Undercoat Layer

An example of the undercoat layer is a layer containing inorganic particles and a binder resin.

Examples of the inorganic particles include inorganic particles having a powder resistance (volume resistivity) ranging from $10^2$ Ωcm to $10^{11}$ Ωcm.

Specific examples of the inorganic particles having such a resistance include metal oxide particles such as tin oxide particles, titanium oxide particles, zinc oxide particles, and zirconium oxide particles; in particular, zinc oxide particles are suitable.

The specific surface area of the inorganic particles, which is measured by a BET method, is, for example, suitably 10 $m^2/g$ or more.

The volume average particle size of the inorganic particles is, for instance, suitably from 50 nm to 2000 nm (preferably from 60 nm to 1000 nm).

The amount of the inorganic particles is, for example, preferably from 10 weight % to 80 weight %, and more preferably from 40 weight % to 80 weight % relative the amount of the binder resin.

The inorganic particles are optionally subjected to a surface treatment. Two or more types of inorganic particles subjected to different surface treatments or having different particle sizes may be used in combination.

Examples of a surface treatment agent to be used include a silane coupling agent, a titanate-based coupling agent, an aluminum-based coupling agent, and a surfactant. In particular, a silane coupling agent is preferred, and a silane coupling agent having an amino group is more preferred.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination. The silane coupling agent having an amino group may be, for example, used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Any of known surface treatments with surface treatment agents may be employed, and either of a dry process and a wet process may be performed.

The amount of the surface treatment agent to be used is, for instance, suitably from 0.5 weight % to 10 weight % relative to the inorganic particle content.

The undercoat layer may contain an electron-accepting compound (acceptor compound) in addition to the inorganic particles in terms of enhancements in the long-term stability of electrical properties and carrier-blocking properties.

Examples of the electron-accepting compound include electron-transporting materials, for instance, quinone compounds such as chloranil and bromoanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, the electron-accepting compound is suitably a compound having an anthraquinone structure. Suitable examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer in a state in which it is dispersed along with the inorganic particles or in a state in which it is adhering to the surfaces of the inorganic particles.

The electron-accepting compound is allowed to adhere to the surfaces of the inorganic particles through, for example, a dry process or a wet process.

In a dry process, for instance, the inorganic particles are stirred with a mixer or another equipment having a large shear force, and the electron-accepting compound itself or a solution of the electron-accepting compound in an organic solvent is dropped or sprayed with dry air or nitrogen gas thereto under the stirring, thereby allowing the electron-accepting compound to adhere to the surfaces of the inorganic particles. The dropping or spraying of the electron-accepting compound may be performed at a temperature less than or equal to the boiling point of the solvent. After the dropping or spraying of the electron-accepting compound, the resulting product may be optionally baked at not less than 100° C. The baking may be performed at any temperature for any length of time provided that electrophotographic properties can be produced.

In a wet process, for example, the inorganic particles are dispersed in a solvent by a technique that involves use of stirring, ultrasonic, a sand mill, an attritor, or a ball mill; the electron-accepting compound is added thereto and then stirred or dispersed; and the solvent is subsequently removed, thereby allowing the electron-accepting compound to adhere to the surfaces of the inorganic particles. The solvent is removed, for instance, by filtration or distillation. After the removal of the solvent, the resulting product may be optionally baked at not less than 100° C. The baking may be performed at any temperature for any length of time provided that electrophotographic properties can be produced. In the wet process, the moisture content in the inorganic particles may be removed before the addition of the electron-accepting compound; examples of a technique for the removal include a technique in which the moisture is removed in a solvent under stirring and heating and a technique in which the moisture is removed through azeotropy with a solvent.

The electron-accepting compound may be allowed to adhere to the surfaces of the inorganic particles before or after the inorganic particles are subjected to the surface treatment with a surface treatment agent, and the process for the adhesion of the electron-accepting compound and the surface treatment may be performed at the same time.

The amount of the electron-accepting compound is, for example, suitably from 0.01 weight % to 20 weight %, and preferably from 0.01 weight % to 10 weight % relative to the inorganic particle content.

Examples of the binder resin used for forming the undercoat layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin used for forming the undercoat layer include charge-transporting resins having charge-transporting groups and conductive resins (e.g., polyaniline).

The binder resin used for forming the undercoat layer is suitably insoluble in a solvent used to form the upper layer. In particular, suitable resins are thermosetting resins, such as urea resins, phenolic resins, phenol-formaldehyde resins, melamine resins, urethane resins, unsaturated polyester resins, alkyd resins, and epoxy resins, and resins produced through the reaction of a curing agent with at least one resin selected from the group consisting of polyamide resins, polyester resins, polyether resins, methacrylic resins, acrylic resins, polyvinyl alcohol resins, and polyvinyl acetal resins.

In the case where two or more of these binder resins are used in combination, the mixture ratio is appropriately determined.

The undercoat layer may contain a variety of additives to enhance electrical properties, environmental stability, and image quality.

Examples of the additives include known materials such as electron-transporting pigments (e.g., condensed polycyclic pigments and azo pigments), zirconium chelate compounds, titanium chelate compounds, aluminum chelate compounds, titanium alkoxide compounds, organic titanium compounds, and silane coupling agents. A silane coupling agent is used for the surface treatment of the inorganic particles as described above; however, it may be further added, as an additive, to the undercoat layer.

Examples of the silane coupling agents as the additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, ammonium salts of titanium lactate, titanium lactate, ethyl esters of titanium lactate, titanium triethanol aminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or in the form of a mixture or polycondensate of multiple compounds.

The undercoat layer desirably has a Vickers hardness of not less than 35.

The surface roughness (ten-point average roughness) of the undercoat layer is desirably adjusted to be from 1/(4n) (n is a refractive index of the upper layer) to ½ of the wavelength λ of laser light to be used for exposure in order to reduce Moire fringes.

The undercoat layer may contain, for example, resin particles in order to adjust the surface roughness. Examples of the resin particles include silicone resin particles and crosslinkable polymethyl methacrylate resin particles. The surface of the undercoat layer may be polished to adjust the surface roughness. Examples of a polishing technique include buff polishing, sandblasting, wet honing, and grinding.

The undercoat layer may be formed by any of known techniques; for instance, the above-mentioned components are added to a solvent to prepare a coating liquid used for forming the undercoat layer, the coating liquid is used to form a coating film, and the coating film is dried and optionally heated.

Examples of the solvent used in the preparation of the coating liquid used for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of such solvents include typical organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a technique for dispersing the inorganic particles in the preparation of the coating liquid used for forming the undercoat layer include known techniques that involve use of a roll mill, a ball mill, a vibratory ball mill, an attritor, a sand mill, a colloid mill, or a paint shaker.

Examples of a technique for applying the coating liquid used for forming the undercoat layer onto the conductive substrate include typical techniques such as blade coating, wire bar coating, spray coating, dip coating, bead coating, air knife coating, and curtain coating.

The thickness of the undercoat layer is, for example, preferably 15 μm or more, and more preferably from 20 μm to 50 μm.

Intermediate Layer

Although not illustrated, an intermediate layer may be further provided between the undercoat layer and the photosensitive layer.

An example of the intermediate layer is a layer containing resin. Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

These compounds used for forming the intermediate layer may be used alone or in the form of a mixture or polycondensate of multiple compounds.

In particular, the intermediate layer is suitably a layer containing an organic metal compound that contains a zirconium atom or a silicon atom.

The intermediate layer may be formed by any of known techniques; for instance, the above-mentioned components are added to a solvent to prepare a coating liquid used for forming the intermediate layer, the coating liquid is used to form a coating film, and the coating film is dried and optionally heated.

Examples of a technique for applying the coating liquid used for forming the intermediate layer include typical techniques such as dip coating, push-up coating, wire bar coating, spray coating, blade coating, knife coating, and curtain coating.

The thickness of the intermediate layer is suitably adjusted to be, for instance, from 0.1 μm to 3 μm. The intermediate layer may serve as the undercoat layer.

Charge-Generating Layer

An example of the charge-generating layer is a layer containing a charge-generating material and a binder resin. The charge-generating layer may be a deposited layer of a charge-generating material. The deposited layer of a charge-generating material is suitable for the case in which an incoherent light source such as a light emitting diode (LED) or an organic electro-luminescence (EL) image array is used.

Examples of the charge-generating material include azo pigments such as bisazo pigments and trisazo pigments; fused ring aromatic pigments such as dibromoanthanthrone; perylene pigments; pyrrolopyrrole pigments; phthalocyanine pigments; zinc oxide; and trigonal selenium.

In particular, suitable charge-generating materials to enable exposure to laser light having a wavelength that is in a near infrared region are metal phthalocyanine pigments and metal-free phthalocyanine pigments. Specific examples thereof include hydroxygallium phthalocyanine, chlorogallium phthalocyanine, dichlorotin phthalocyanine, and titanyl phthalocyanine.

Suitable charge-generating materials to enable exposure to laser light having a wavelength that is in a near ultraviolet region are fused ring aromatic pigments such as dibromoanthanthrone, thioindigo pigments, porphyrazine compounds, zinc oxide, trigonal selenium, and bisazo pigments.

The above-mentioned charge-generating materials may be used also in the case where an incoherent light source such as an LED or organic EL image array having a central emission wavelength ranging from 450 nm to 780 nm is used; however, when the photosensitive layer has a thickness of not more than 20 μm in terms of resolution, the field intensity in the photosensitive layer becomes high, which easily results in a decrease in the degree of charging due to electric charges injected from the substrate, namely the occurrence of image defects called black spots. This phenomenon is more likely to be caused in the case of using charge-generating materials that are p-type semiconductors and that easily generate dark current, such as trigonal selenium and a phthalocyanine pigment.

Use of charge-generating materials that are n-type semiconductors, such as fused ring aromatic pigments, perylene pigments, and azo pigments, is less likely to generate dark current and enables a reduction in the occurrence of image defects called black spots even at the reduced thickness of the photosensitive layer.

In order to distinguish an n-type charge-generating material, a time-of-flight technique that has been generally employed is used to analyze the polarity of flowing photoelectric current, and a material in which electrons are likely to flow as carriers rather than holes is determined as an n-type charge-generating material.

The binder resin used for forming the charge-generating layer is selected from a variety of insulating resins and may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (such as a polycondensate made from a bisphenol and an aromatic divalent carboxylic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" herein refers to a volume resistivity of not less than $10^{13}$ Ωm.

These binder resins may be used alone or in combination.

The mixture ratio of the charge-generating material to the binder resin is suitably from 10:1 to 1:10 on a weight basis.

The charge-generating layer may further contain a known additive.

The charge-generating layer may be formed by any of known techniques; for instance, the above-mentioned components are added to a solvent to prepare a coating liquid used for forming the charge-generating layer, the coating liquid is used to form a coating film, and the coating film is dried and optionally heated. The charge-generating layer may be formed by depositing the charge-generating material. Such formation of the charge-generating layer by deposition is suitable particularly in the case of using a fused ring aromatic pigment or a perylene pigment as the charge-generating material.

Examples of the solvent used in the preparation of the coating liquid used for forming the charge-generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination.

Particles (e.g., charge-generating material) are, for example, dispersed in the coating liquid used for forming the charge-generating layer with a disperser involving use of media, such as a ball mill, a vibratory ball mill, an attritor, a sand mill, or horizontal sand mill, or with a media-free disperser such as a stirrer, an ultrasonic disperser, a roll mill, and a high-pressure homogenizer. Examples of the high-pressure homogenizer include an impact-type homogenizer in which a highly pressurized dispersion liquid is allowed to collide with another liquid or a wall for dispersion and a through-type homogenizer in which a highly pressurized dispersion liquid is allowed to flow through a fine flow channel for dispersion.

In this dispersion procedure, it is effective that the average particle size of the charge-generating material used in the coating liquid for forming the charge-generating layer is not more than 0.5 μm, preferably not more than 0.3 μm, and more preferably not more than 0.15 μm.

Examples of a technique for applying the coating liquid used for forming the charge-generating layer onto the undercoat layer (or intermediate layer) include typical techniques such as blade coating, wire bar coating, spray coating, dip coating, bead coating, air knife coating, and curtain coating.

The thickness of the charge-generating layer is, for example, adjusted to be preferably from 0.1 μm to 5.0 μm, and more preferably 0.2 μm to 2.0 μm.

Charge-Transporting Layer

An example of the charge-transporting layer is a layer containing a charge-transporting material and a binder resin.

The charge-transporting material includes a first charge-transporting material having two triphenylamine skeletons and a charge mobility of approximately $4\times10^{-6}$ $cm^2/Vs$ or more and at least one second charge-transporting material selected from the group consisting of a charge-transporting material having one triphenylamine skeleton and a charge mobility of approximately $5\times10^{-5}$ $cm^2/Vs$ or more, a charge-transporting material having two triphenylamine skeletons and being different from the first charge-transporting material, and a charge-transporting material having three triphenylamine skeletons. The second charge-transporting material content is approximately from 0.2 weight % to 1.0 weight % relative to the total charge-transporting material content.

The charge mobility of the charge-transporting materials is measured as follows.

A layer that is a film that contains a charge-transporting layer at a concentration of 50 weight % relative to a bisphenol Z polycarbonate resin is formed on an indium tin oxide (ITO) substrate, and semi-transparent gold electrodes are formed on the surface thereof by sputtering to prepare a sample for measuring charge mobility. Charge mobility is measured by a time-of-flight (TOF) method. Voltage is applied to the measurement sample to a field intensity of $3.0\times10^5$ V/cm. Then, a nitrogen pulse laser (wavelength: 337 nm) is radiated thereto, and the waveform of generated transient current is analyzed with a high-speed current amplifier and a digital oscilloscope. The relationship between current and time is subjected to logarithmic conversion, and charge mobility is calculated from the time at the inflection point of the obtained curve. The larger the value, the better electrical properties.

The first charge-generating material has two triphenylamine skeletons and a charge mobility of approximately $4\times10^{-6}$ $cm^2/Vs$ or more (suitably $5\times10^{-6}$ $cm^2/Vs$ or more). The upper limit of the charge mobility of the first charge-transporting material is not particularly determined; for example, it is up to $1\times10^{-5}$ $cm^2/Vs$.

Any material can be used as the first charge-transporting material provided that it has two triphenylamine skeletons and a charge mobility of approximately $4\times10^{-6}$ $cm^2/Vs$ or more. The first charge-transporting material to be used may be, for example, a compound represented by General Formula (CT2-2), which will be described later as an example of a charge-transporting material, provided that it has a charge mobility of approximately $4\times10^{-6}$ $cm^2/Vs$ or more.

The first charge-transporting material is suitably N,N'-diphenyl-N,N'-bis(3-methylphenyl)-1,1'-biphenyl-4,4'-diamine represented by Structural Formula (CT1) because it has a high charge mobility and enables an easy reduction in the crystallization of the charge-generating material.

(CT1)

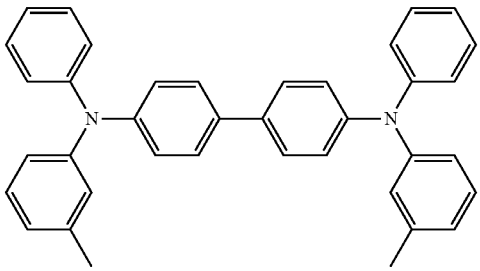

The second charge-transporting material will now be described.

The second charge-transporting material is at least one charge-transporting material selected from the group consisting of a charge-transporting material having one triphenylamine skeleton and a charge mobility of approximately $5\times10^{-5}$ $cm^2/Vs$ or more, a charge-transporting material having two triphenylamine skeletons and being different from the first charge-transporting material, and a charge-transporting material having three triphenylamine skeletons.

The charge-transporting material having one triphenylamine skeleton and a charge mobility of approximately $5\times10^{-5}$ $cm^2/Vs$ or more will now be described.

The charge-transporting material having one triphenylamine skeleton and a charge mobility of approximately $5\times10^{-5}$ $cm^2/Vs$ or more (suitably $7\times10^{-5}$ $cm^2/Vs$ or more) is not particularly limited. The charge mobility of this charge-transporting material may be equivalent to or greater than that of the first charge-transporting material. The upper limit of the charge mobility is not particularly determined; for example, it is up to $1\times10^{-4}$ $cm^2/Vs$.

Such a charge-transporting material may be, for example, a butadiene-based charge-transporting material represented by General Formula (CT2-1) in view of charge mobility.

Butadiene-Based Charge-Transporting Material

The butadiene-based charge-transporting material is a charge-transporting material represented by General Formula (CT2-1).

In General Formula (CT2-1), $R^{C11}$, $R^{C12}$, $R^{C13}$, $R^{C14}$, $R^{C15}$, and $R^{C16}$ each independently represent a hydrogen atom, a halogen atom, an alkyl group having from 1 to 20 carbon atoms, an alkoxy group having from 1 to 20 carbon atoms, or an aryl group having from 6 to 30 carbon atoms; and the adjoining two of these substituents may be bonded to each other into a hydrocarbon ring structure.

n and m each independently represent 0, 1, or 2.

In General Formula (CT2-1), examples of the halogen atom that $R^{C11}$, $R^{C12}$, $R^{C13}$, $R^{C14}$, $R^{C15}$, and $R^{C16}$ represent include a fluorine atom, a chlorine atom, a bromine atom, and an iodine atom. Among these, the halogen atom is preferably a fluorine atom or a chlorine atom, and more preferably a chlorine atom.

In General Formula (CT2-1), examples of the alkyl group that $R^{C11}$, $R^{C12}$, $R^{C13}$, $R^{C14}$, $R^{C15}$, and $R^{C16}$ represent include linear or branched alkyl groups each having from 1 to 20 carbon atoms (preferably from 1 to 6 carbon atoms, and more preferably from 1 to 4 carbon atoms).

Specific examples of the linear alkyl group include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, and an n-icosyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an (CT2-1)

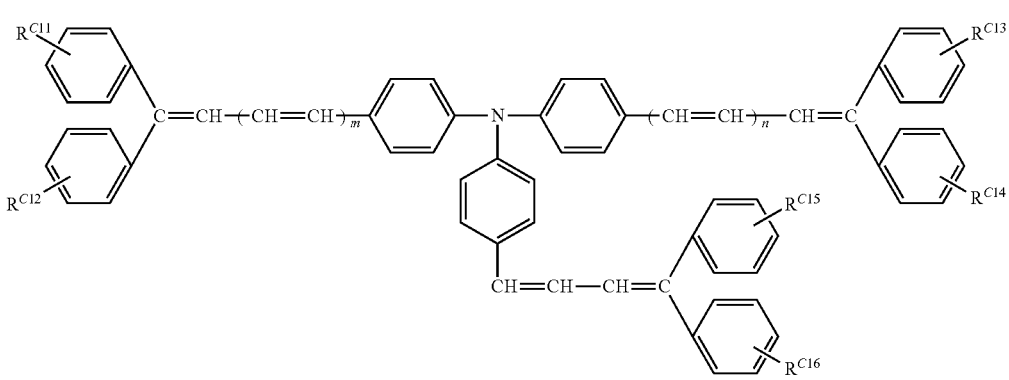

isononadecyl group, a sec-nonadecyl group, a tert-nonadecyl group, a neononadecyl group, a 1-methyloctyl group, an isoicosyl group, a sec-isoicosyl group, a tert-icosyl group, and a neoicosyl group.

Among these, lower alkyl groups, such as a methyl group, an ethyl group, and an isopropyl group, are suitable as the alkyl group.

In General Formula (CT2-1), examples of the alkoxy group that $R^{C11}$, $R^{C12}$, $R^{C13}$, $R^{C14}$, $R^{C15}$, and $R^{C16}$ represent include linear or branched alkoxy groups each having from 1 to 20 carbon atoms (preferably from 1 to 6 carbon atoms, and more preferably from 1 to 4 carbon atoms).

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, an n-undecyloxy group, an n-dodecyloxy group, an n-tridecyloxy group, an n-tetradecyloxy group, an n-pentadecyloxy group, an n-hexadecyloxy group, an n-heptadecyloxy group, an n-octadecyloxy group, an n-nonadecyloxy group, and an n-icosyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoicosyloxy group, a sec-icosyloxy group, a tert-icosyloxy group, and a neoicosyloxy group.

Among these, a methoxy group is suitable as the alkoxy group.

In General Formula (CT2-1), examples of the aryl group that $R^{C11}$, $R^{C12}$, $R^{C13}$, $R^{C14}$, $R^{C15}$, and $R^{C16}$ represent include aryl groups each having from 6 to 30 carbon atoms (preferably from 6 to 20 carbon atoms, and more preferably from 6 to 16 carbon atoms).

Specific examples of the aryl group include a phenyl group, a naphthyl group, a phenanthryl group, and a biphenylyl group.

Among these, a phenyl group and a naphthyl group are suitable as the aryl group.

In General Formula (CT2-1), the substituents that $R^{C11}$, $R^{C12}$, $R^{C13}$, $R^{C14}$, $R^{C15}$, and $R^{C16}$ represent also include groups each further having a substituent. Examples of such a substituent include the atoms and groups described above as examples (such as a halogen atom, an alkyl group, an alkoxy group, and an aryl group).

In General Formula (CT2-1), in a hydrocarbon ring structure in which two adjoining substituents out of $R^{C11}$, $R^{C12}$, $R^{C13}$, $R^{C14}$, $R^{C15}$, and $R^{C16}$ (for example, $R^{C11}$ and $R^{C12}$, $R^{C13}$ and $R^{C14}$, or $R^{C15}$ and $R^{C16}$) are bonded to each other, the substituents are bonded to each other via, for instance, a single bond, a 2,2'-methylene group, a 2,2'-ethylene group, or a 2,2'-vinylene group; among these, a single bond and a 2,2'-methylene group are suitable.

Specific examples of the hydrocarbon ring structure include a cycloalkane structure, a cycloalkane structure, and a cycloalkane polyene structure.

In General Formula (CT2-1), n and m are each suitably 1.

In General Formula (CT2-1), in order to form a photosensitive layer (charge-transporting layer) having a high capability of transporting charges, it is preferred that $R^{C11}$, $R^{C12}$, $R^{C13}$, $R^{C14}$, $R^{C15}$, and $R^{C16}$ each independently represent a hydrogen atom, an alkyl group having from 1 to 20 carbon atoms, or an alkoxy group having from 1 to 20 carbon atoms and that m and n each represent 1 or 2; and it is more preferred that $R^{C11}$, $R^{C12}$, $R^{C13}$, $R^{C14}$, $R^{C15}$, and $R^{C16}$ represent a hydrogen atom and that m and n each represent 1.

In particular, the butadiene-based charge-transporting material (CT2-1) is suitably a charge-transporting material represented by Structural Formula (CT2-1A) [example compound (CT2-1-3)].

(CT2-1A)

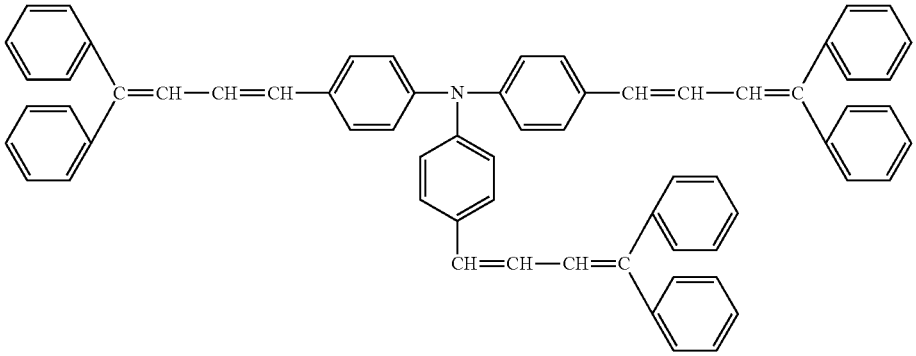

Specific examples of the butadiene-based charge-transporting material (CT2-1) will now be given, but the butadiene-based charge-transporting material (CT2-1) are not limited thereto.

| No. | m | n | $R^{C11}$ | $R^{C12}$ | $R^{C13}$ | $R^{C14}$ | $R^{C15}$ | $R^{C16}$ |
|---|---|---|---|---|---|---|---|---|
| CT2-1-1 | 1 | 1 | 4-$CH_3$ | 4-$CH_3$ | 4-$CH_3$ | 4-$CH_3$ | H | H |
| CT2-1-2 | 2 | 2 | H | H | H | H | 4-$CH_3$ | 4-$CH_3$ |
| CT2-1-3 | 1 | 1 | H | H | H | H | H | H |
| CT2-1-4 | 2 | 2 | H | H | H | H | H | H |
| CT2-1-5 | 1 | 1 | 4-$CH_3$ | 4-$CH_3$ | 4-$CH_3$ | H | H | H |
| CT2-1-6 | 0 | 1 | H | H | H | H | H | H |
| CT2-1-7 | 0 | 1 | 4-$CH_3$ | 4-$CH_3$ | 4-$CH_3$ | 4-$CH_3$ | 4-$CH_3$ | 4-$CH_3$ |
| CT2-1-8 | 0 | 1 | 4-$CH_3$ | 4-$CH_3$ | H | H | 4-$CH_3$ | 4-$CH_3$ |
| CT2-1-9 | 0 | 1 | H | H | 4-$CH_3$ | 4-$CH_3$ | H | H |
| CT2-1-10 | 0 | 1 | H | H | 4-$CH_3$ | 4-$CH_3$ | H | H |
| CT2-1-11 | 0 | 1 | 4-$CH_3$ | H | H | H | 4-$CH_3$ | H |
| CT2-1-12 | 0 | 1 | 4-$OCH_3$ | H | H | H | 4-$OCH_3$ | H |
| CT2-1-13 | 0 | 1 | H | H | 4-$OCH_3$ | 4-$OCH_3$ | H | H |
| CT2-1-14 | 0 | 1 | 4-$OCH_3$ | H | 4-$OCH_3$ | H | 4-$OCH_3$ | 4-$OCH_3$ |
| CT2-1-15 | 0 | 1 | 3-$CH_3$ | H | 3-$CH_3$ | H | 3-$CH_3$ | H |
| CT2-1-16 | 1 | 1 | 4-$CH_3$ | 4-$CH_3$ | 4-$CH_3$ | 4-$CH_3$ | 4-$CH_3$ | 4-$CH_3$ |
| CT2-1-17 | 1 | 1 | 4-$CH_3$ | 4-$CH_3$ | H | H | 4-$CH_3$ | 4-$CH_3$ |
| CT2-1-18 | 1 | 1 | H | H | 4-$CH_3$ | 4-$CH_3$ | H | H |
| CT2-1-19 | 1 | 1 | H | H | 3-$CH^3$ | 3-$CH_3$ | H | H |
| CT2-1-20 | 1 | 1 | 4-$CH_3$ | H | H | H | 4-$CH_3$ | H |
| CT2-1-21 | 1 | 1 | 4-$OCH_3$ | H | H | H | 4-$OCH_3$ | H |
| CT2-1-22 | 1 | 1 | H | H | 4-$OCH_3$ | 4-$OCH_3$ | H | H |
| CT2-1-23 | 1 | 1 | 4-$OCH_3$ | H | 4-$OCH_3$ | H | 4-$OCH_3$ | 4-$OCH_3$ |
| CT2-1-24 | 1 | 1 | 3-$CH_3$ | H | 3-$CH_3$ | H | 3-$CH_3$ | H |

In the above example compounds, the abbreviations have the following meanings. The numbers given before the substituents are each a site of substitution on the benzene ring.

—$CH_3$: methyl group

—$OCH_3$: methoxyl group

The butadiene-based charge-transporting materials (CT2-1) may be used alone or in combination.

Charge-Transporting Material Having Two Triphenylamine Skeletons and being Different from First Charge-Transporting Material The charge-transporting material having two triphenylamine skeletons and being different from the first charge-transporting material will now be described.

The charge-transporting material having two triphenylamine skeletons and being different from the first charge-transporting material is not particularly limited; for example, it may be a charge-transporting material that is a charge-transporting material represented by General Formula (CT2-2) and that is different from the first charge-transporting material.

(CT2-2)

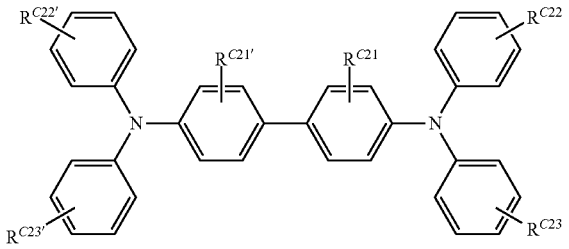

In General Formula (CT2-2), $R^{C21}$, $R^{C22}$, $R^{C23}$, $R^{C21'}$, $R^{C22'}$, and $R^{C23'}$ each independently represent a hydrogen atom, a halogen atom, a hydroxyl group, a formyl group, an alkyl group, an alkoxy group, or an aryl group.

In General Formula (CT2-2), examples of the halogen atom that $R^{C21}$, $R^{C22}$, $R^{C23}$, $R^{C21'}$, $R^{C22'}$, and $R^{C23'}$ represent include a fluorine atom, a chlorine atom, a bromine atom, and an iodine atom. Among these, the halogen atom is preferably a fluorine atom or a chlorine atom, and more preferably a chlorine atom.

In General Formula (CT2-2), examples of the alkyl group that $R^{C21}$, $R^{C22}$, $R^{C23}$, $R^{C21'}$, $R^{C22'}$, and $R^{C23'}$ represent include linear or branched alkyl groups each having from 1 to 10 carbon atoms (preferably from 1 to 6 carbon atoms, and more preferably from 1 to 4 carbon atoms).

Specific examples of the linear alkyl group include a methyl group, an ethyl group, an n-propyl group, an n-butyl group, an n-pentyl group, an n-hexyl group, an n-heptyl group, an n-octyl group, an n-nonyl group, and an n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups, such as a methyl group, an ethyl group, and an isopropyl group, are suitable as the alkyl group.

In General Formula (CT2-2), examples of the alkoxy group that $R^{C21}$, $R^{C22}$, $R^{C23}$, $R^{C21'}$, $R^{C22'}$, and $R^{C23'}$ represent include linear or branched alkoxy groups each having from 1 to 10 carbon atoms (preferably from 1 to 6 carbon atoms, and more preferably from 1 to 4 carbon atoms).

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, and an n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, a methoxy group is suitable as the alkoxy group.

In General Formula (CT2-2), examples of the aryl group that $R^{C21}$, $R^{C22}$, $R^{C23}$, $R^{C21'}$, $R^{C22'}$, and $R^{C23'}$ represent include linear or branched aryl groups each having from 6 to 10 carbon atoms (preferably from 6 to 9 carbon atoms, and more preferably from 6 to 8 carbon atoms).

Specific examples of the aryl group include a phenyl group and a naphthyl group.

Among these, a phenyl group is suitable as the aryl group.

In General Formula (CT2-2), the substituents represented by $R^{C21}$, $R^{C22}$, $R^{C23}$, $R^{C21'}$, $R^{C22'}$, and $R^{C23'}$ also include a group further having a substituent. Examples of this substituent include the atoms and groups described above as examples (such as a halogen atom, an alkyl group, an alkoxy group, and an aryl group).

In order to reduce the crystallization of the charge-transporting material, $R^{C21}$, $R^{C22}$, $R^{C23}$, $R^{C21'}$, $R^{C22'}$, and $R^{C23'}$ in General Formula (CT2-2) each independently suitably represent a hydrogen atom, a hydroxyl group, a formyl group, or an alkyl group having from 1 to 6 carbon atoms (particularly, a methyl group). $R^{C21}$ and $R^{C21'}$ each preferably represent a hydrogen atom; $R^{C22}$ preferably represents a hydrogen atom, a hydroxyl group, or a methyl group; $R^{C23}$ preferably represents a hydrogen atom, a formyl group, or a methyl group; $R^{C22'}$ preferably represents a hydrogen atom; and $R^{C23'}$ preferably represents a methyl group. In particular, $R^{C21}$, $R^{C22}$, and $R^{C23}$ are more preferably different from $R^{C21'}$, $R^{C22'}$, and $R^{C23'}$, respectively, to form an asymmetric structure.

Specific examples of the charge-transporting material represented by General Formula (CT2-2) will now be given, but the charge-transporting material represented by General Formula (CT2-2) are not limited thereto.

| No | $R^{C21}$ | $R^{C22}$ | $R^{C23}$ | $R^{C21'}$ | $R^{C22'}$ | $R^{C23'}$ |
|---|---|---|---|---|---|---|
| CT2-2-1 | H | 2-OH | 3-$CH_3$ | H | H | 3-$CH_3$ |
| CT2-2-2 | H | 3-OH | 3-$CH_3$ | H | H | 3-$CH_3$ |
| CT2-2-3 | H | 4-OH | 3-$CH_3$ | H | H | 3-$CH_3$ |
| CT2-2-4 | H | H | 3-CHO | H | H | 3-$CH_3$ |
| CT2-2-5 | H | H | H | H | H | 3-$CH_3$ |
| CT2-2-6 | H | 2-$CH_3$ | 3-$CH_3$ | H | H | 3-$CH_3$ |
| CT2-2-7 | H | 3-$CH_3$ | 3-$CH_3$ | H | H | 3-$CH_3$ |
| CT2-2-8 | H | 4-$CH_3$ | 3-$CH_3$ | H | H | 3-$CH_3$ |
| CT2-2-9 | H | H | 4-$CH_3$ | H | H | 4-$CH_3$ |
| CT2-2-10 | H | H | 3-$C_2H_5$ | H | H | 3-$C_2H_5$ |
| CT2-2-11 | H | H | 4-$C_2H_5$ | H | H | 4-$C_2H_5$ |
| CT2-2-12 | H | H | 3-$OCH_3$ | H | H | 3-$OCH_3$ |
| CT2-2-13 | H | H | 4-$OCH_3$ | H | H | 4-$OCH_3$ |
| CT2-2-14 | H | H | 3-$OC_2H_5$ | H | H | 3-$OC_2H_5$ |
| CT2-2-15 | H | H | 4-$OC_2H_5$ | H | H | 4-$OC_2H_5$ |
| CT2-2-16 | H | 3-$CH_3$ | 3-$CH_3$ | H | 3-$CH_3$ | 3-$CH_3$ |
| CT2-2-17 | H | 4-$CH_3$ | 4-$CH_3$ | H | 4-$CH_3$ | 4-$CH_3$ |
| CT2-2-18 | H | 3-$C_2H_5$ | 3-$C_2H_5$ | H | 3-$C_2H_5$ | 3-$C_2H_5$ |
| CT2-2-19 | H | 4-$C_2H_5$ | 4-$C_2H_5$ | H | 4-$C_2H_5$ | 4-$C_2H_5$ |
| CT2-2-20 | 2-$CH_3$ | H | H | 2-$CH_3$ | H | H |
| CT2-2-21 | 3-$CH_3$ | H | H | 3-$CH_3$ | H | H |
| CT2-2-22 | 2-$CH_3$ | H | 3-$CH_3$ | 2-$CH_3$ | H | 3-$CH_3$ |
| CT2-2-23 | 3-$CH_3$ | H | 3-$CH_3$ | 3-$CH_3$ | H | 3-$CH_3$ |
| CT2-2-24 | 2-$CH_3$ | H | 4-$CH_3$ | 2-$CH_3$ | H | 4-$CH_3$ |
| CT2-2-25 | 3-$CH_3$ | H | 4-$CH_3$ | 3-$CH_3$ | H | 4-$CH_3$ |

-continued

| No | $R^{C21}$ | $R^{C22}$ | $R^{C23}$ | $R^{C21'}$ | $R^{C22'}$ | $R^{C23'}$ |
|---|---|---|---|---|---|---|
| CT2-2-26 | 2-$CH_3$ | 3-$CH_3$ | 3-$CH_3$ | 2-$CH_3$ | 3-$CH_3$ | 3-$CH_3$ |
| CT2-2-27 | 3-$CH_3$ | 3-$CH_3$ | 3-$CH_3$ | 3-$CH_3$ | 3-$CH_3$ | 3-$CH_3$ |
| CT2-2-28 | 2-$CH_3$ | 4-$CH_3$ | 4-$CH_3$ | 2-$CH_3$ | 4-$CH_3$ | 4-$CH_3$ |
| CT2-2-29 | 3-$CH_3$ | 4-$CH_3$ | 4-$CH_3$ | 3-$CH_3$ | 4-$CH_3$ | 4-$CH_3$ |

In the above example compounds, the abbreviations have the following meanings. The numbers given before the substituents are each a site of substitution on the benzene ring.

—$CH_3$: methyl group

—$C_2H_5$: ethyl group

—$OCH_3$: methoxyl group

—$OC_2H_5$: ethoxy group

—CHO: formyl group

The charge-transporting materials represented by General Formula (CT2-2) may be used alone or in combination.

In the case where the charge-transporting material represented by General Formula (CT2-2) is used as the second charge-transporting material, the second charge-transporting material has a different structure from the first charge-transporting material.

Charge-Transporting Material Having Three Triphenylamine Skeletons

The charge-transporting material having three triphenylamine skeletons will now be described.

The charge-transporting material having three triphenylamine skeletons is not particularly limited; for example, it may be at least one of a charge-transporting material represented by General Formula (CT2-3) and a charge-transporting material represented by General Formula (CT2-4). Either of the charge-transporting material represented by General Formula (CT2-3) and the charge-transporting material represented by General Formula (CT2-4) may be used, or both of them may be used.

(CT2-3)

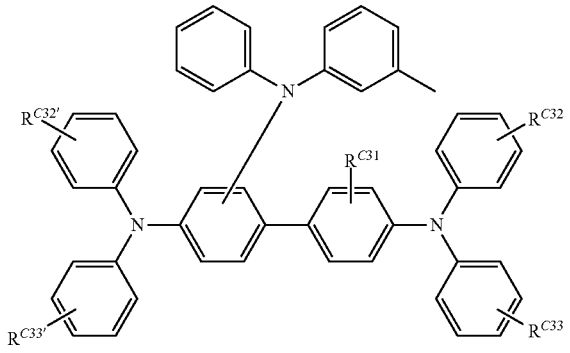

In General Formula (CT2-3), $R^{C31}$, $R^{C32}$, $R^{C33}$, $R^{C32'}$, and $R^{C33'}$ each independently represent a hydrogen atom, a halogen atom, a hydroxyl group, a formyl group, an alkyl group, an alkoxy group, or an aryl group.

(CT2-4)

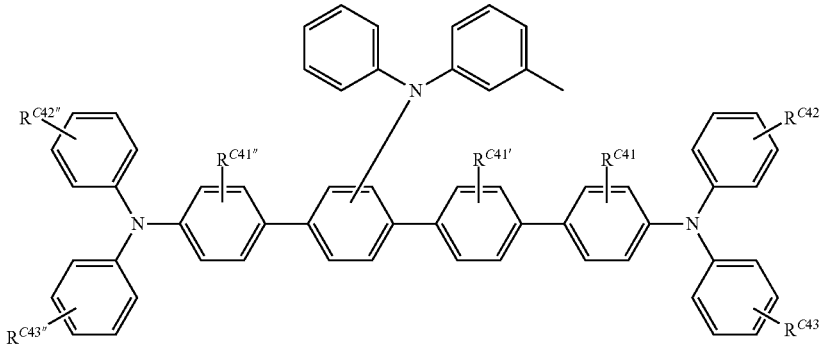

In General Formula (CT2-4), $R^{C41}$, $R^{C42}$, $R^{C43}$, $R^{C41''}$, $R^{C41''}$, $R^{C42''}$, and $R^{C43''}$ each independently represent a hydrogen atom, a halogen atom, a hydroxyl group, a formyl group, an alkyl group, an alkoxy group, or an aryl group.

Examples of the halogen atom, alkyl group, alkoxy group, and aryl group represented by $R^{C31}$, $R^{C32}$, $R^{C33}$, $R^{C32'}$, and $R^{C33'}$ in General Formula (CT2-3) and examples of the halogen atom, alkyl group, alkoxy group, and aryl group represented by $R^{C41}$, $R^{C42}$, $R^{C43}$, $R^{C41'}$, $R^{C41''}$, $R^{C42''}$, and $R^{C43''}$ in General Formula (CT2-4) are the same as the examples of the halogen atom, alkyl group, alkoxy group, and aryl group represented by $R^{C21}$, $R^{C22}$, $R^{C23}$, $R^{C21'}$, $R^{C22'}$, and $R^{C23'}$ in General Formula (CT2-2).

In General Formula (CT2-3), particularly in order to reduce the crystallization of the charge-transporting material, $R^{C31}$, $R^{C32}$, $R^{C33}$, and $R^{C32'}$ each independently preferably represent a hydrogen atom, a hydroxyl group, a formyl group, or an alkyl group having from 1 to 6 carbon atoms (especially, a methyl group). From the same point of view, $R^{C31}$ more preferably represents a hydrogen atom, $R^{c32}$ more preferably represents a hydrogen atom, $R^{C33}$ more preferably represents a methyl group, $R^{C32'}$ more preferably represents a hydrogen atom, and $R^{C33'}$ more preferably represents a methyl group.

In General Formula (CT2-4), particularly in order to reduce the crystallization of the charge-transporting material, $R^{C41}$, $R^{C42}$, $R^{C43}$, $R^{C41''}$, $R^{C41''}$, $R^{C42''}$, and $R^{C43''}$ independently preferably represent a hydrogen atom, a hydroxyl group, a formyl group, or an alkyl group having from 1 to 6 carbon atoms (especially, a methyl group). From the same point of view, $R^{C41}$, $R^{C41'}$, and $R^{C41''}$ more preferably represent a hydrogen atom; $R^{C42}$ and $R^{C42''}$ more preferably represent a hydrogen atom or a hydroxyl group; and $R^{C43}$ and $R^{C43''}$ more preferably represent a formyl group or a methyl group.

Specific examples of the charge-transporting material represented by General Formula (CT2-3) and the charge-transporting material represented by General Formula (CT2-4) will now be given, but the charge-transporting material represented by General Formula (CT2-3) and the charge-transporting material represented by General Formula (CT2-4) are not limited thereto.

| No | $R^{C31}$ | $R^{C32}$ | $R^{C33}$ | 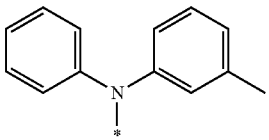 * | $R^{C32'}$ | $R^{C33'}$ |
|---|---|---|---|---|---|---|
| CT2-3-1 | H | H | 3-$CH_3$ | 3-* | H | 3-$CH_3$ |
| CT2-3-2 | H | H | 3-$CH_3$ | 2-* | H | 3-$CH_3$ |
| CT2-3-3 | H | 2-OH | 3-$CH_3$ | 2-* | H | 3-$CH_3$ |
| CT2-3-4 | H | 3-OH | 3-$CH_3$ | 2-* | H | 3-$CH_3$ |
| CT2-3-5 | H | 4-OH | 3-$CH_3$ | 2-* | H | 3-$CH_3$ |
| CT2-3-6 | H | H | 3CHO | 2-* | H | 3-$CH_3$ |
| CT2-3-7 | H | H | H | 2-* | H | 3-$CH_3$ |
| CT2-3-8 | H | 2-$CH_3$ | 3-$CH_3$ | 2-* | H | 3-$CH_3$ |
| CT2-3-9 | H | 3-$CH_3$ | 3-$CH_3$ | 2-* | H | 3-$CH_3$ |
| CT2-3-10 | H | 4-$CH_3$ | 3-$CH_3$ | 2-* | H | 3-$CH_3$ |
| CT2-3-11 | H | 2-OH | 3-$CH_3$ | 3-* | H | 3-$CH_3$ |
| CT2-3-12 | H | 3-OH | 3-$CH_3$ | 3-* | H | 3-$CH_3$ |
| CT2-3-13 | H | 4-OH | 3-$CH_3$ | 3-* | H | 3-$CH_3$ |
| CT2-3-14 | H | H | 3-CHO | 3-* | H | 3-$CH_3$ |
| CT2-3-15 | H | H | H | 3-* | H | 3-$CH_3$ |
| CT2-3-16 | H | 2-$CH_3$ | 3-$CH_3$ | 3-* | H | 3-$CH_3$ |
| CT2-3-17 | H | 3-$CH_3$ | 3-$CH_3$ | 3-* | H | 3-$CH_3$ |
| CT2-3-18 | H | 4-$CH_3$ | 3-$CH_3$ | 3-* | H | 3-$CH_3$ |
| CT2-3-19 | H | 3-OH | 3-$CH_3$ | 2-* | 3-OH | 3-$CH_3$ |
| CT2-3-20 | H | 4-OH | 3-$CH_3$ | 2-* | 4-OH | 3-$CH_3$ |
| CT2-3-21 | H | 3-OH | 3-$CH_3$ | 3-* | 3-OH | 3-$CH_3$ |
| CT2-3-22 | H | 4-OH | 3-$CH_3$ | 3-* | 4-OH | 3-$CH_3$ |
| CT2-3-23 | H | H | 3-CHO | 2-* | H | 3-CHO |
| CT2-3-24 | H | H | 3-CHO | 3-* | H | 3-CHO |

In the above example compounds, the abbreviations have the following meanings. The numbers given before the substituents are each a site of substitution on the benzene ring. The symbol "*" represents a binding site.

—$CH_3$: methyl group

—CHO: formyl group

—OH: hydroxyl group

The charge-transporting materials represented by General Formula (CT2-3) may be used alone or in combination.

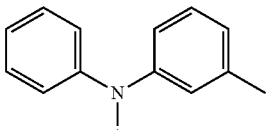

| No | $R^{C41}$ | $R^{C42}$ | $R^{C43}$ | $R^{C41'}$ | * | $R^{C41''}$ | $R^{C42''}$ | $R^{C43''}$ |
|---|---|---|---|---|---|---|---|---|
| CT2-4-1 | H | H | 3-$CH_3$ | H | 3-* | H | H | 3-$CH_3$ |
| CT2-4-2 | H | H | 3-$CH_3$ | H | 2-* | H | H | 3-$CH_3$ |
| CT2-4-3 | H | 2-OH | 3-$CH_3$ | H | 2-* | H | 2-OH | 3-$CH_3$ |
| CT2-4-4 | H | 2-OH | 3-$CH_3$ | H | 2-* | H | 3-OH | 3-$CH_3$ |
| CT2-4-5 | H | 2-OH | 3-$CH_3$ | H | 2-* | H | 4-OH | 3-$CH_3$ |
| CT2-4-6 | H | 3-OH | 3-$CH_3$ | H | 2-* | H | 2-OH | 3-$CH_3$ |
| CT2-4-7 | H | 3-OH | 3-$CH_3$ | H | 2-* | H | 3-OH | 3-$CH_3$ |
| CT2-4-8 | H | 3-OH | 3-$CH_3$ | H | 2-* | H | 4-OH | 3-$CH_3$ |
| CT2-4-9 | H | 4-OH | 3-$CH_3$ | H | 2-* | H | 2-OH | 3-$CH_3$ |
| CT2-4-10 | H | 4-OH | 3-$CH_3$ | H | 2-* | H | 3-OH | 3-$CH_3$ |
| CT2-4-11 | H | 4-OH | 3-$CH_3$ | H | 2-* | H | 4-OH | 3-$CH_3$ |
| CT2-4-12 | H | 2-OH | 3-$CH_3$ | H | 3-* | H | 2-OH | 3-$CH_3$ |
| CT2-4-13 | H | 2-OH | 3-$CH_3$ | H | 3-* | H | 3-OH | 3-$CH_3$ |
| CT2-4-14 | H | 2-OH | 3-$CH_3$ | H | 3-* | H | 4-OH | 3-$CH_3$ |
| CT2-4-15 | H | 3-OH | 3-$CH_3$ | H | 3-* | H | 2-OH | 3-$CH_3$ |
| CT2-4-16 | H | 3-OH | 3-$CH_3$ | H | 3-* | H | 3-OH | 3-$CH_3$ |
| CT2-4-17 | H | 3-OH | 3-$CH_3$ | H | 3-* | H | 4-OH | 3-$CH_3$ |
| CT2-4-18 | H | 4-OH | 3-$CH_3$ | H | 3-* | H | 2-OH | 3-$CH_3$ |
| CT2-4-19 | H | 4-OH | 3-$CH_3$ | H | 3-* | H | 3-OH | 3-$CH_3$ |
| CT2-4-20 | H | 4-OH | 3-$CH_3$ | H | 3-* | H | 4-OH | 3-$CH_3$ |
| CT2-4-21 | H | H | 3-CHO | H | 2-* | H | H | 3-CHO |
| CT2-4-22 | H | H | 3-CHO | H | 3-* | H | H | 3-CHO |

In the above example compounds, the abbreviations have the following meanings. The numbers given before the substituents are each a site of substitution on the benzene ring. The symbol "*" represents a binding site.

—$CH_3$: methyl group

—CHO: formyl group

—OH: hydroxyl group

The charge-transporting materials represented by General Formula (CT2-4) may be used alone or in combination.

The second charge-transporting material content will now be described.

The second charge-transporting material content is in the range of approximately 0.2 weight % to 1.0 weight % relative to the total charge-transporting material content as described above. The second charge-transporting material content is suitably in the range of approximately 0.3 weight % to 0.5 weight % relative to the total charge-transporting material content in terms of further reductions in the crystallization of the charge-transporting material and impairment of electrical properties.

The second charge-transporting material content refers to the total amount of the charge-transporting material having one triphenylamine skeleton and a charge mobility of approximately $5\times10^{-5}$ $cm^2/Vs$ or more, the charge-transporting material having two triphenylamine skeletons and being different from the first charge-transporting material, and the charge-transporting material having three triphenylamine skeletons. In the case where, for example, the second charge-transporting material is a combination of the charge-transporting material having two triphenylamine skeletons and being different from the first charge-transporting material and the charge-transporting material having three triphenylamine skeletons, the second charge-transporting material content refers to the total amount thereof.

The total charge-transporting material content refers to the total amount of the first charge-transporting material and the second charge-transporting materials.

The second charge-transporting material content, in other words, the total amount of the charge-transporting material having one triphenylamine skeleton and a charge mobility of approximately $5\times10^{-5}$ $cm^2/Vs$ or more, the charge-transporting material having two triphenylamine skeletons and being different from the first charge-transporting material, and the charge-transporting material having three triphenylamine skeletons, is approximately from 0.2 weight to 1.0 weight relative to the total amount of the first charge-transporting material and the second charge-transporting materials.

Examples of the binder resin used in the charge-transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are suitably used as the binder resin. These binder resins are used alone or in combination.

The mixing ratio of the charge-transporting material to the binder resin is suitably from 10:1 to 1:5 on a weight basis.

The charge-transporting layer may further contain a known additive.

The charge-transporting layer may be formed by any of known techniques; for instance, the above-mentioned components are added to a solvent to prepare a coating liquid used for forming the charge-transporting layer, the coating liquid is used to form a coating film, and the coating film is dried and optionally heated.

Examples of the solvent used in the preparation of the coating liquid used for forming the charge-transporting layer include typical organic solvents, e.g., aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or straight-chain ethers such as tetrahydrofuran and ethyl ether. These solvents are used alone or in combination.

Examples of a technique for applying the coating liquid used for forming the charge-transporting layer onto the charge-generating layer include typical techniques such as blade coating, wire bar coating, spray coating, dip coating, bead coating, air knife coating, and curtain coating.

The thickness of the charge-transporting layer is, for instance, adjusted to be preferably from 5 μm to 50 μm, and more preferably from 20 μm to 40 μm.

The photosensitive layer (charge-transporting layer) having the above-mentioned structure serves to reduce the crystallization of the charge-transporting materials used in the photosensitive layer (charge-transporting layer) and to suppress impairment of electrical properties.

The crystallization of the charge-transporting materials in the photosensitive layer (charge-transporting layer) is evaluated as follows.

A photosensitive layer is taken out of a photoreceptor that is to be analyzed. A small piece is cut out of the photosensitive layer, embedded in an epoxy resin, and then solidified. A slice of the resulting product is prepared with a microtome and used as an observation sample. The observation sample is observed with JSM-6700F (manufactured by JEOL Ltd.) as a scanning electron microscope (SEM) to analyze the state of the deposit of the charge-transporting materials.

Protective Layer

The protective layer is optionally formed on the photosensitive layer. The protective layer is formed, for instance, in order to prevent the photosensitive layer from being chemically changed in the charging and to improve the mechanical strength of the photosensitive layer.

Hence, the protective layer is properly a layer of a cured film (crosslinked film). Examples of such a layer include the following layers (1) and (2).

(1) Layer of a cured film made of a composition that contains a reactive-group-containing charge-transporting material of which one molecule has both a reactive group and a charge-transporting skeleton (in other words, layer containing a polymer or crosslinked product of the reactive-group-containing charge-transporting material)

(2) Layer of a cured film made of a composition that contains a nonreactive charge-transporting material and a reactive-group-containing non-charge-transporting material that does not have a charge-transporting skeleton but has a reactive group (in other words, layer containing polymers or crosslinked products of the nonreactive charge-transporting material and reactive-group-containing non-charge-transporting material)

Examples of the reactive group of the reactive-group-containing charge-transporting material include known reactive groups such as a chain polymerizable group, an epoxy group, —OH, —OR (where R represents an alkyl group), $—NH_2$, —SH, —COOH, and $—SiR^{Q1}_{3-Qn}(OR^{Q2})_{Qn}$ (where $R^{Q1}$ represents a hydrogen atom, an alkyl group, or a substituted or unsubstituted aryl group; $R^{Q2}$ represents a hydrogen atom, an alkyl group, or a trialkylsilyl group; and Qn represents an integer from 1 to 3).

Any chain polymerizable group may be employed provided that it is a functional group that enables a radical polymerization; for example, a functional group at least containing a group with a carbon double bond may be employed. Specific examples thereof include groups containing at least one selected from a vinyl group, a vinyl ether group, a vinyl thioether group, a styryl group, a vinylphenyl group, an acryloyl group, a methacryloyl group, and derivatives thereof. Among these, suitable chain polymerizable groups are groups containing at least one selected from a vinyl group, a styryl group, a vinylphenyl group, an acryloyl group, a methacryloyl group, and derivatives thereof because they have excellent reactivity.

The charge-transporting skeleton of the reactive-group-containing charge-transporting material is not particularly limited provided that it is a known structure in the field of electrophotographic photoreceptors. Examples of such a structure include skeletons that are derived from nitrogen-containing hole-transporting compounds, such as triarylamine compounds, benzidine compounds, and hydrazone compounds, and that are conjugated with a nitrogen atom. In particular, triarylamine skeletons are suitable.

The reactive-group-containing charge-transporting material having both a reactive group and a charge-transporting skeleton, the nonreactive charge-transporting material, and the reactive-group-containing non-charge transporting material may be selected from known materials.

The protective layer may further contain a known additive.

The protective layer may be formed by any of known techniques; for instance, the above-mentioned components are added to a solvent to prepare a coating liquid used for forming the protective layer, the coating liquid is used to form a coating film, and the coating film is dried and optionally heated for curing.

Examples of the solvent used in the preparation of the coating liquid used for forming the protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents are used alone or in combination.

The coating liquid used for forming the protective layer may be a solventless coating liquid.

Examples of a technique for applying the coating liquid used for forming the protective layer onto the photosensitive layer (e.g., charge-transporting layer) include typical techniques such as dip coating, push-up coating, wire bar coating, spray coating, blade coating, knife coating, and curtain coating.

The thickness of the protective layer is, for instance, adjusted to be preferably from 1 μm to 20 μm, and more preferably from 2 μm to 10 μm.

Single-Layer Photosensitive Layer

The single-layer photosensitive layer (charge-generating/charge-transporting layer) is, for example, a layer containing a charge-generating material, a charge-transporting material, and optionally a binder resin and another known additive. These materials are the same as those described as the materials used for forming the charge-generating layer and the charge-transporting layer.

The amount of the charge-generating material contained in the single-layer photosensitive layer is suitably from 10 weight % to 85 weight %, and preferably from 20 weight % to 50 weight % relative to the total solid content. The amount of the charge-transporting material contained in the single-layer photosensitive layer is suitably from 5 weight % to 50 weight % relative to the total solid content.

The single-layer photosensitive layer is formed by the same technique as those for forming the charge-generating layer and the charge-transporting layer.

The thickness of the single-layer photosensitive layer is, for instance, suitably from 5 μm to 50 μm, and preferably from 10 μm to 40 μm.

Image Forming Apparatus (and Process Cartridge)

An image forming apparatus according to a second exemplary embodiment includes an electrophotographic photoreceptor, a charging device that serves to charge the surface of the electrophotographic photoreceptor, an electrostatic latent image forming device that serves to form an electrostatic latent image on the charged surface of the electrophotographic photoreceptor, a developing device that serves to develop the electrostatic latent image on the surface of the electrophotographic photoreceptor with a developer containing toner to form a toner image, and a transfer device that serves to transfer the toner image to the surface of a recording medium. The electrophotographic photoreceptor is the electrophotographic photoreceptor according to the first exemplary embodiment.

The image forming apparatus according to the second exemplary embodiment may be any of the following known image forming apparatuses: an apparatus which has a fixing device that serves to fix the toner image transferred to the surface of a recording medium, a direct-transfer-type apparatus in which the toner image formed on the surface of the electrophotographic photoreceptor is directly transferred to a recording medium, an intermediate-transfer-type apparatus in which the toner image formed on the surface of the electrophotographic photoreceptor is subjected to first transfer to the surface of an intermediate transfer body and in which the toner image transferred to the surface of the intermediate transfer body is then subjected to second transfer to the surface of a recording medium, an apparatus which has a cleaning device that serves to clean the surface of the electrophotographic photoreceptor after the transfer of a toner image and before the charging of the electrophotographic photoreceptor, an apparatus which has a charge-neutralizing device that serves to radiate light to the surface of the electrophotographic photoreceptor for removal of charges after the transfer of a toner image and before the charging of the electrophotographic photoreceptor, and an apparatus which has an electrophotographic photoreceptor heating member that serves to heat the electrophotographic photoreceptor to decrease the relative temperature.

In the intermediate-transfer-type apparatus, the transfer device, for example, includes an intermediate transfer body of which a toner image is to be transferred to the surface, a first transfer device which serves for first transfer of the toner image formed on the surface of the electrophotographic photoreceptor to the surface of the intermediate transfer body, and a second transfer device which serves for second transfer of the toner image transferred to the surface of the intermediate transfer body to the surface of a recording medium.

The image forming apparatus according to the second exemplary embodiment may be either of a dry development type and a wet development type (development with a liquid developer is performed).

In the structure of the image forming apparatus according to the second exemplary embodiment, for instance, the part that includes the electrophotographic photoreceptor may be in the form of a cartridge that is removably attached to the image forming apparatus (process cartridge). A suitable example of the process cartridge to be used is a process cartridge including the electrophotographic photoreceptor according to the first exemplary embodiment. The process cartridge may include, in addition to the electrophotographic photoreceptor, at least one selected from the group consisting of, for example, the charging device, the electrostatic latent image forming device, the developing device, and the transfer device.

An example of the image forming apparatus according to the second exemplary embodiment will now be described; however, the image forming apparatus according to the second exemplary embodiment is not limited thereto. The parts shown in the drawing are described, while description of the other parts is omitted.

Figure 2:
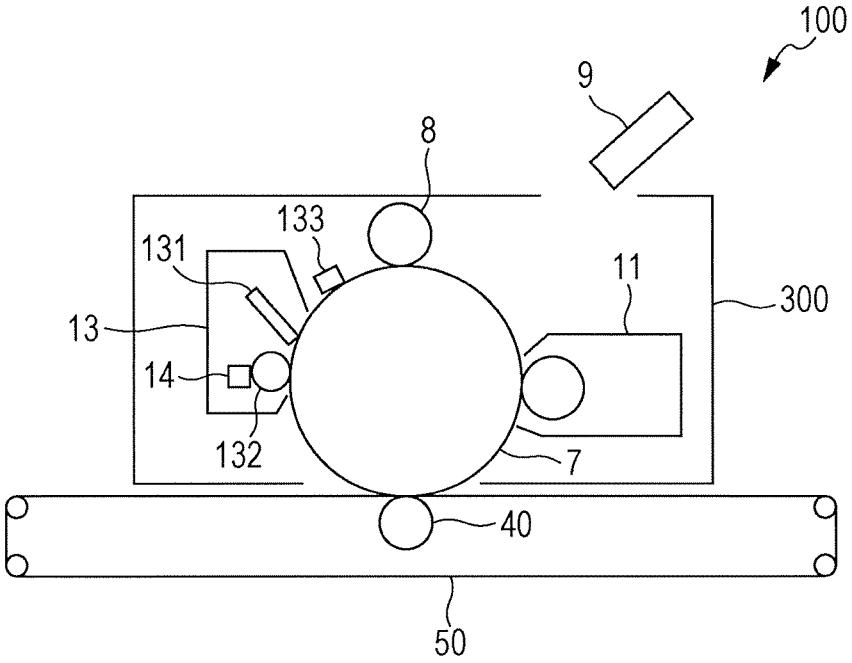
FIG. 2 schematically illustrates an example of the structure of an image forming apparatus according to a second exemplary embodiment.

FIG. 2 schematically illustrates an example of the structure of the image forming apparatus according to the second exemplary embodiment.

As illustrated in FIG. 2, an image forming apparatus 100 according to the second exemplary embodiment includes a process cartridge 300 having an electrophotographic photoconductor 7, an exposure device 9 (example of the electrostatic latent image forming device), a transfer device 40 (first transfer device), and an intermediate transfer body 50. In the image forming apparatus 100, the exposure device 9 is disposed such that the electrophotographic photoreceptor 7 can be irradiated with light through the opening of the process cartridge 300, the transfer device 40 is disposed so as to face the electrophotographic photoreceptor 7 with the intermediate body 50 interposed therebetween, and the intermediate body 50 is placed such that part thereof is in contact with the electrophotographic photoreceptor 7. Although not illustrated, the image forming apparatus also includes a second transfer device that serves to transfer a toner image transferred to the intermediate transfer body 50 to a recording medium (e.g., paper). In this case, the intermediate transfer body 50, the transfer device 40 (first transfer device), and the second transfer device (not illustrated) are an example of the transfer device.

In the process cartridge 300 illustrated in FIG. 2, a housing integrally accommodates the electrophotographic photoconductor 7, the charging device 8 (example of the charging device), the developing device 11 (example of the developing device), and the cleaning device 13 (example of the cleaning device). The cleaning device 13 has a cleaning blade 131 (example of a cleaning member), and the cleaning blade 131 is disposed so as to be in contact with the surface of the electrophotographic photoreceptor 7. The cleaning member does not need to be in the form of the cleaning blade 131 but may be a conductive or insulating fibrous member; this fibrous member may be used alone or in combination with the cleaning blade 131.

The example of the image forming apparatus in FIG. 2 includes a fibrous member 132 (roll) that serves to supply a lubricant 14 to the surface of the electrophotographic photoconductor 7 and a fibrous member 133 (flat brush) that supports the cleaning, and these members are optionally placed.

Each part of the image forming apparatus according to the second exemplary embodiment will now be described.

Charging Device

Examples of the charging device 8 include contact-type chargers that involve use of a conductive or semi-conductive charging roller, charging brush, charging film, charging rubber blade, or charging tube. Any of other known chargers may be used, such as a non-contact-type roller charger and a scorotron or corotron charger in which corona discharge is utilized.

Exposure Device

Examples of the exposure device 9 include optical systems that expose the surface of the electrophotographic photoreceptor 7 to light, such as light emitted from a semiconductor laser, an LED, or a liquid crystal shutter, in the shape of the intended image. The wavelength of light source is within the spectral sensitivity of the electrophotographic photoreceptor. The light from a semiconductor laser is generally near-infrared light having an oscillation wavelength near 780 nm. The wavelength of the light is, however, not limited thereto; laser light having an oscillation wavelength of the order of 600 nm or blue laser light having an oscillation wavelength ranging from 400 nm to 450 nm may be employed. A surface-emitting laser source that can emit multiple beams is also effective for formation of color images.

Developing Device

Examples of the developing device 11 include general developing devices that develop images through contact or non-contact with a developer. The developing device 11 is not particularly limited provided that it has the above-mentioned function, and a proper structure for the intended use is selected. An example of the developing device 11 is a known developing device that serves to attach a one-component or two-component developer to the electrophotographic photoreceptor 7 with a brush or a roller. In particular, a developing device including a developing roller of which the surface holds a developer is suitable.

The developer used in the developing device 11 may be either of a one-component developer of toner alone and a two-component developer containing toner and a carrier. The developer may be either magnetic or non-magnetic. Any of known developers may be used.

Cleaning Device

The cleaning device 13 is a cleaning-blade type in which the cleaning blade 131 is used.

The cleaning device 13 may have a structure other than the cleaning-blade type; in particular, fur brush cleaning may be employed, or the cleaning may be performed at the same time as the developing.

Transfer Device

Examples of the transfer device 40 include known transfer chargers such as contact-type transfer chargers having a belt, a roller, a film, or a rubber blade and scorotron or corotron transfer chargers in which corona discharge is utilized.

Intermediate Transfer Body

The intermediate transfer body 50 is, for instance, in the form of a belt (intermediate transfer belt) containing a semi-conductive polyimide, polyamide imide, polycarbonate, polyarylate, polyester, or rubber. The intermediate transfer body may be in the form other than a belt, such as a drum.

Figure 3:
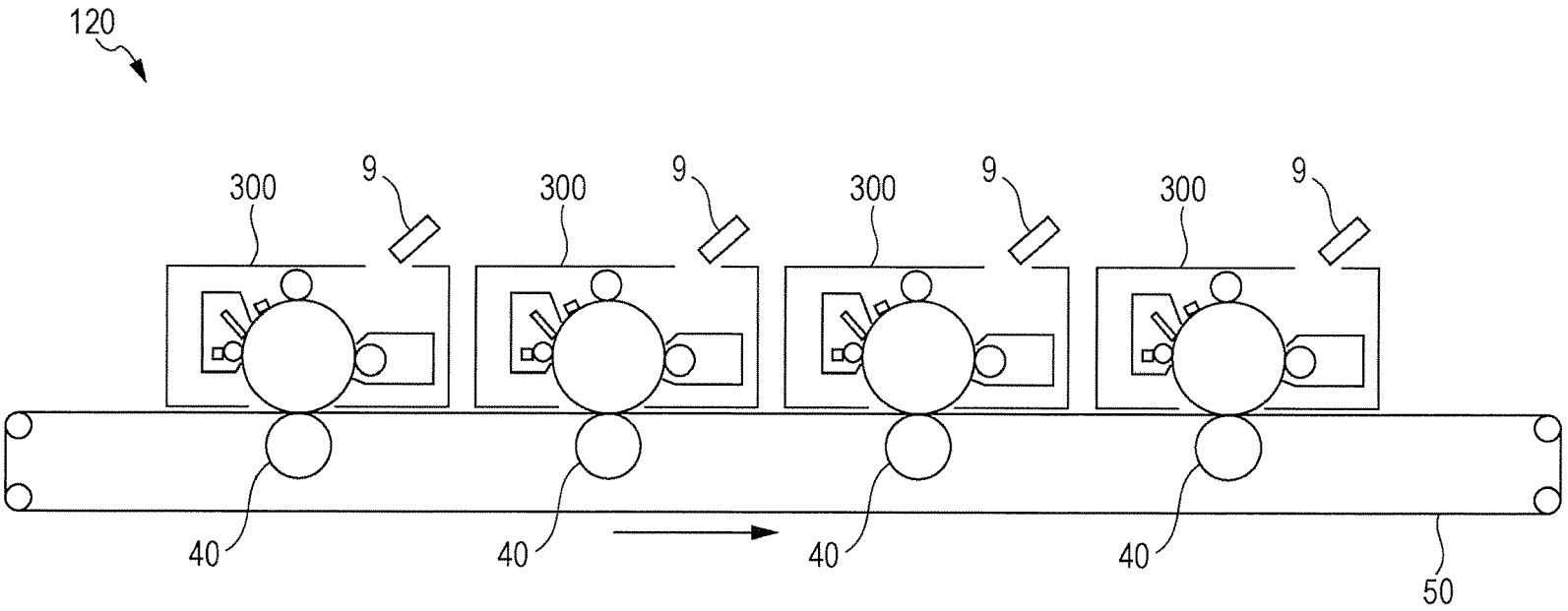
FIG. 3 schematically illustrates another example of the structure of the image forming apparatus according to the second exemplary embodiment.

FIG. 3 schematically illustrates another example of the structure of the image forming apparatus according to the second exemplary embodiment.

An image forming apparatus 120 illustrated in FIG. 3 is a tandem-type multicolor image forming apparatus including four process cartridges 300. In the image forming apparatus 120, the four process cartridges 300 are disposed in parallel so as to overlie the intermediate transfer body 50, and one electrophotographic photoreceptor serves for one color. Except that the image forming apparatus 120 is a tandem type, it has the same structure as the image forming apparatus 100.

EXAMPLES

Exemplary embodiments of the invention will now be further specifically described on the basis of Examples and Comparative Examples but are not limited thereto. The terms "part" and "%" are on a weight basis unless otherwise specified.

Example 1

Formation of Undercoat Layer

With 100 parts by weight of zinc oxide (trade name: MZ 300, manufactured by TAYCA CORPORATION), 10 parts by weight of a toluene solution of 10-weight % N-2-(aminoethyl)-3-aminopropyltriethoxysilane as a silane coupling agent and 200 parts by weight of toluene are mixed. Then, the mixture is stirred and subsequently refluxed for two hours. The toluene is distilled off under reduced pressure at 10 mmHg, and the resulting product is baked at 135° C. for 2 hours for treatment of the surface of the zinc oxide with the silane coupling agent.

Then, 33 parts by weight of the surface-treated zinc oxide is mixed with 6 parts by weight of blocked isocyanate (trade name: SUMIDUR 3175, manufactured by Sumitomo Bayer Urethane Co., Ltd.), 1 part by weight of a compound represented by Structural Formula (AQ-1), and 25 parts by weight of methyl ethyl ketone over 30 minutes. Then, 5 parts by weight of a butyral resin (trade name: S-LEC BM-1, manufactured by SEKISUI CHEMICAL CO., LTD.), 3 parts by weight of silicone balls (trade name TOSPEARL 120 manufactured by Momentive Performance Materials Inc.), and 0.01 part by weight of a leveling agent that is a silicone oil (trade name: SH29PA, manufactured by Dow Corning Toray Silicone Co., Ltd.) are added to the mixture. The resulting mixture is subjected to dispersion with a sand mill for three hours to yield a coating liquid used for forming an undercoat layer.

The coating liquid used for forming an undercoat layer is applied onto an aluminum substrate having a diameter of 47 mm, a length of 357 mm, and a thickness of 1 mm by dip coating and dried and cured at 180° C. for 30 minutes to form an undercoat layer having a thickness of 25 μm.

AQ-1

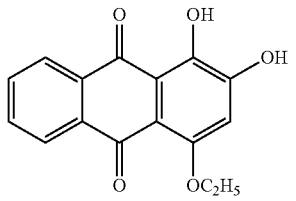

Formation of Charge-Generating Layer

A mixture of 18 parts by weight of a hydroxygallium phthalocyanine pigment as a charge-generating material, 16 parts by weight of a vinyl chloride-vinyl acetate copolymer resin (trade name: VMCH, manufactured by Nippon Unicar Company Limited) as a binder resin, and n-butyl acetate as a solvent is put into a glass bottle having a capacity of 100 mL along with glass beads having a diameter of 1.0 mm at a filling rate of 50%. The content is subjected to dispersion with a paint shaker for 2.5 hours to produce a coating liquid used for forming a charge-generating layer. The solid content is 6.0 weight % relative to the whole coating liquid used for forming a charge-generating layer.

The coating liquid used for forming a charge-generating layer is applied onto the undercoat layer by dip coating and dried at 100° C. for 5 minutes to form a charge-generating layer having a thickness of 0.20 μm.

Formation of Charge-Transporting Layer

N,N'-diphenyl-N,N'-bis(3-methylphenyl)-1,1'-biphenyl-4,4'-diamine as the first charge-transporting material and a second charge-transporting material are prepared; the amounts (part by weight) and types thereof are shown in Table 1. The prepared first and second charge-transporting materials and 57 parts by weight of a bisphenol-Z-type polycarbonate resin (homopolymeric polycarbonate resin of bisphenol Z, viscosity average molecular weight: 40,000) as a binder resin are dissolved in 340 parts by weight of tetrahydrofuran as a solvent to yield a coating liquid used for forming a charge-transporting layer.

The coating liquid used for forming a charge-transporting layer is not filtrated with a filter.

The coating liquid used for forming a charge-transporting layer is applied onto the charge-generating layer by dip coating and dried at 150° C. for 40 minutes to form a charge-transporting layer having a thickness of 40 μm.

Through this process, an electrophotographic photoreceptor of Example 1 has been produced.

Examples 2 to 6

The amount of the first charge-transporting material and the amount and type of the second charge-transporting material are changed as shown in Table 1. Except for this change, electrophotographic photoreceptors of Example 2 to 6 are produced as in Example 1.

Comparative Example 1

In the formation of the charge-transporting layer, only N,N'-diphenyl-N,N'-bis(3-methylphenyl)-1,1'-biphenyl-4,4'-diamine is used as the charge-transporting material, and the resulting coating liquid used for forming a charge-transporting layer is filtrated with a filter. Except for these changes, an electrophotographic photoreceptor of Comparative Example 1 is produced as in Example 1.

Comparative Examples 2 to 5

N,N'-diphenyl-N,N'-bis(3-methylphenyl)-1,1'-biphenyl-4,4'-diamine as the charge-transporting material is used in combination with a second charge-transporting material, and the amount of the first charge-transporting material and the amount and type of the second charge-transporting material are changed as shown in Table 1. Except for these changes, electrophotographic photoreceptors of Comparative Examples 2 to 5 are produced as in Comparative Example 1. Only in Comparative Example 3, the coating liquid used for forming a charge-transporting layer is not filtrated with a filter.

Evaluations

The electrophotographic photoreceptors produced in Examples and Comparative Examples are subjected to "Evaluation of Crystallization of Charge-transporting Material in Photosensitive Layer", "Evaluation of Color Spots", "Evaluation of Ghosts", "Evaluation of Image-Burn In", and "Evaluation of Light Fatigue" that will be described in detail below. Table 1 shows results of the evaluations.

Evaluation of Crystallization of Charge-Transporting Material in Photosensitive Layer The surface of the charge-transporting layer is observed with an SEM apparatus in the manner described above. The result of the observation is evaluated on the basis of the following criteria.

Evaluation Criteria

G1: Less than 1 crystallized part observed within a 1-$mm^2$ area of the surface G2: 1 or more but less than 3 crystallized parts observed within a 1-$mm^2$ area of the surface G3: 3 or more but less than 5 crystallized parts observed within a 1-$mm^2$ area of the surface G4: 5 or more but less than 7 crystallized parts observed within a 1-$mm^2$ area of the surface G5: 7 or more crystallized parts observed within a 1-$mm^2$ area of the surface Evaluation of Color Spots The electrophotographic photoreceptors produced in Examples and Comparative Examples are individually attached to an electrophotographic image forming apparatus (ApeosPort C2275 manufactured by Fuji Xerox Co., Ltd.), and a sheet of which a half-tone image (cyan) has been formed on the entire surface at an image density of 20% is output. The half-tone image on the output sheet is visually observed for a sensory evaluation (grading). The grades are from G0 to G6, one by one; the smaller the number appended to "G" is, the better the evaluation result is. Grades of G3 or better are acceptable.

The image is output at 10° C. and 15% RH in any case.

Evaluation of Ghosts

The electrophotographic photoreceptors produced in Examples and Comparative Examples are individually attached to an electrophotographic image forming apparatus (ApeosPort C2275 manufactured by Fuji Xerox Co., Ltd.). A sheet of A3 paper on which an image of a chart with a pattern having a letter of G and a black part (solid black image) is output, and then a sheet of which a half-tone image has been formed on the entire surface at an image density of 20% (half-tone cyan image formed on the entire surface) is output.

The half-tone image formed on the entire surface of the output sheet is visually observed for a sensory evaluation (grading). The grades are from G0 to G4, one by one; the smaller the number appended to "G" is, the better the evaluation result is. In the evaluation of ghosts, grades of G3 or better are acceptable.

The images are all output at 10° C. and 15% RH in any case.

Evaluation of Image-Burn in

The electrophotographic photoreceptors produced in Examples and Comparative Examples are individually attached to an electrophotographic image forming apparatus (ApeosPort C2275 manufactured by Fuji Xerox Co., Ltd.). Then, 3000 sheets of A3 paper with a chart of a lattice pattern are continuously output, and then a sheet of A3 paper of which a half-tone image has been formed on the entire surface at an image density of 20% (half-tone cyan image formed on the entire surface) is output.

The half-tone image formed on the entire surface of the output sheet is visually observed for a sensory evaluation (grading) of the difference in image density between the part corresponding to the image of the lattice pattern on the continuously output sheets and the part not corresponding to the image of the lattice pattern. The grades are from G0 to G4, one by one; the smaller the number appended to "G" is, the smaller the difference in image density is, and the less the occurrence of image-burn in is. In the evaluation of image-burn in, grades of G3 or better are acceptable.

The images are all output at 10° C. and 15% RH in any case.

Evaluation of Light Fatigue

Black paper having an opening of a 2-cm square is wrapped around each of the electrophotographic photoreceptors produced in Examples and Comparative Examples. The electrophototraphic photoreceptor is left to stand under radiation of white light from a fluorescent lamp (1000 Lux) for 10 minutes to expose only part of the electrophototraphic photoreceptor corresponding to the opening to the light.

Then, the light-exposed electrophotographic photoreceptor is attached to an electrophotographic image forming apparatus (ApeosPort C2275 manufactured by Fuji Xerox Co., Ltd.), and a sheet of A3 paper of which a half-tone image (cyan) has been formed on the entire surface at an image density of 50% is output.

The half-tone image formed on the entire surface of the output sheet is visually observed for a sensory evaluation (grading) of the difference in image density between the exposed part and non-exposed part. The grades are from G0 to G4, one by one; the smaller the number appended to "G" is, the smaller the difference in image density is, and the less the occurrence of light fatigue is. In the evaluation of light fatigue, grades of G3 or better are acceptable.

The image is output at 10° C. and 15% RH in any case.

TABLE 1

| | Charge-transporting layer | | | | | | Results of evaluations of image quality | | | |
|---|---|---|---|---|---|---|---|---|---|---|
| | First charge-transporting material | | Second charge-transporting material | | | | | | | |
| | Type | Amount (part by weight) | Type | Amount (part by weight) | Proportion to total charge-transporting material content (weight %) | Crystal-lization | Color spots | Ghosts | Image-burn in | Light fatigue |
| Example 1 | CT1 | 42.7 | Mixture of CT2-2 to 4 | 0.3 | 0.7 | G1 | G0 | G0 | G0 | G0 |
| Example 2 | CT1 | 42.9 | Mixture of CT2-2 to 4 | 0.1 | 0.2 | G2 | G2 | G0 | G0 | G0 |
| Example 3 | CT1 | 42.6 | Mixture of CT2-2 to 4 | 0.4 | 0.9 | G1 | G0 | G3 | G3 | G3 |
| Example 4 | CT1 | 42.8 | Mixture of CT2-2 to 4 | 0.2 | 0.5 | G2 | G1 | G0 | G0 | G0 |
| Example 5 | CT1 | 42.9 | CT2-1 | 0.1 | 0.2 | G2 | G2 | G0 | G0 | G0 |
| Example 6 | CT1 | 42.6 | CT2-1 | 0.4 | 0.9 | G1 | G1 | G2 | G2 | G2 |
| Comparative Example 1 | CT1 | 43.0 | — | — | 0.0 | G5 | G6 | G0 | G0 | G0 |
| Comparative Example 2 | CT1 | 42.96 | Mixture of CT2-2 to 4 | 0.04 | 0.1 | G5 | G5 | G0 | G0 | G0 |
| Comparative Example 3 | CT1 | 42.53 | Mixture of CT2-2 to 4 | 0.47 | 1.1 | G1 | G0 | G4 | G4 | G4 |
| Comparative Example 4 | CT1 | 42.7 | CT3 | 0.3 | 0.7 | G3 | G0 | G4 | G4 | G4 |
| Comparative Example 5 | CT1 | 42.96 | CT2-1 | 0.04 | 0.1 | G4 | G5 | G0 | G0 | G0 |

In the above results, the results of the evaluation of crystallization in a photosensitive layer are better in Examples than in Comparative Examples. In Examples, the results of the evaluation of color sports are good, which shows that impairment of electrical properties is reduced.

The occurrence of ghosts, image-burn in, and light fatigue is further reduced in Examples than in Comparative Examples.

In Table 1, the symbol "-" means that the corresponding material is not used. The term "Proportion to total charge-transporting material content (weight %)" refers to the proportion of the second charge-transporting material content to the total amount of the first charge-transporting material and the second charge-transporting material (weight %).

The details of the abbreviations in Table 1 are as follows.

CT1: N,N'-diphenyl-N,N'-bis(3-methylphenyl)-1,1'-biphenyl-4,4'-diamine [compound represented by Structural Formula (CT1) and having a charge mobility of approximately $4\times10^{-6}$ $cm^2/Vs$ that is measured in the manner described above]

CT2-1: example compound (CT2-1-3) of the charge-transporting material (CT2-1) with a charge mobility of approximately $5\times10^{-5}$ $cm^2/Vs$ that is measured in the manner described above Mixture of CT2-2 to 4: mixture of example compounds (CT2-2-1) to (CT2-2-8) of the charge-transporting material (CT2-2), example compounds (CT2-3-1) and (CT2-3-2) of the charge-transporting material (CT2-3), and example compounds (CT2-4-1) to (CT2-4-22) of the charge-transporting material (CT2-4)

CT3: N,N-bis(3,4-dimethylphenyl)-4-biphenylamine [compound represented by Structural Formula (CT3) and having a charge mobility of $9\times10^{-7}$ $cm^2/Vs$ that is measured in the manner described above]

(CT1)

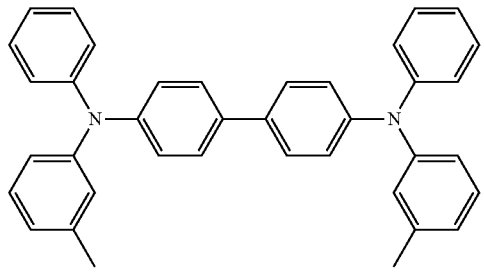

-continued (CT3)

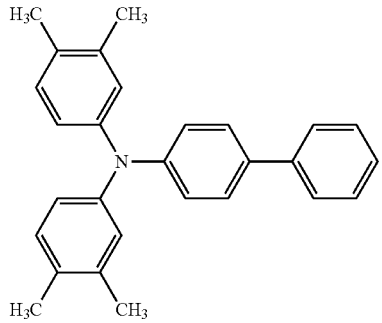

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a photosensitive layer disposed so as to overlie the conductive substrate and containing a first charge-transporting material having two triphenylamine skeletons and a charge mobility of approximately $4\times10^{-6}$ $cm^2/Vs$ or more and a second charge-transporting material comprising a charge-transporting material having three triphenylamine skeletons, wherein the second charge-transporting material content is approximately from 0.2 weight % to 1.0 weight % relative to the total charge-transporting material content.

2. The electrophotographic photoreceptor according to claim 1, wherein the second charge-transporting material content is approximately from 0.3 weight % to 0.5 weight % relative to the total charge-transporting material content in the photosensitive layer.

3. The electrophotographic photoreceptor according to claim 1, wherein the photosensitive layer includes a charge-generating layer and a charge-transporting layer that are disposed so as to overlie the conductive substrate in sequence, the charge-transporting layer contains the first charge-transporting material and the second charge-transporting material, and the second charge-transporting material content is approximately from 0.2 weight % to 1.0 weight % relative to the total charge-transporting material content.

4. The electrophotographic photoreceptor according to claim 3, wherein the second charge-transporting material content is approximately from 0.3 weight % to 0.5 weight % relative to the total charge-transporting material content in the photosensitive layer.

5. The electrophotographic photoreceptor according to claim 1, wherein the first charge-transporting material is N,N'-diphenyl-N,N'-bis(3-methylphenyl)-1,1'-biphenyl-4,4'-diamine.

6. The electrophotographic photoreceptor according to claim 1, wherein the second charge-transporting material further comprises a charge-transporting material having two triphenylamine skeletons and being different from the first charge-transporting material, and the charge-transporting material having two triphenylamine skeletons and being different from the first charge-transporting material is a charge-transporting material represented by General Formula (CT2-2)

(CT2-2)

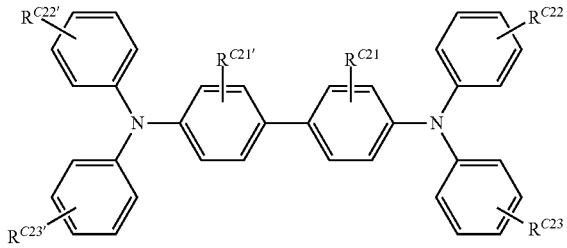

(where $R^{C21}$, $R^{C22}$, $R^{C23}$, $R^{C21'}$, $R^{C22'}$, and $R^{C23'}$ each independently represent a hydrogen atom, a halogen atom, a hydroxyl group, a formyl group, an alkyl group, an alkoxy group, or an aryl group).

7. The electrophotographic photoreceptor according to claim 1, wherein the charge-transporting material having three triphenylamine skeletons is selected from the group consisting of a charge-transporting material represented by General Formula (CT2-3) below and a charge-transporting material represented by General Formula (CT2-4) below (CT2-3)

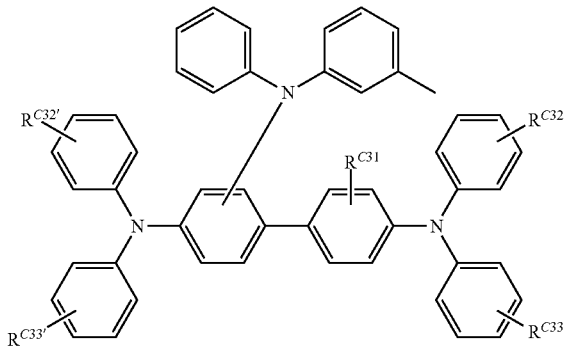

[where $R^{C31}$, $R^{C32}$, $R^{C33}$, $R^{C32'}$, and $R^{C33'}$ each independently represent a hydrogen atom, a halogen atom, a hydroxyl group, a formyl group, an alkyl group, an alkoxy group, or an aryl group]

(CT2-4)

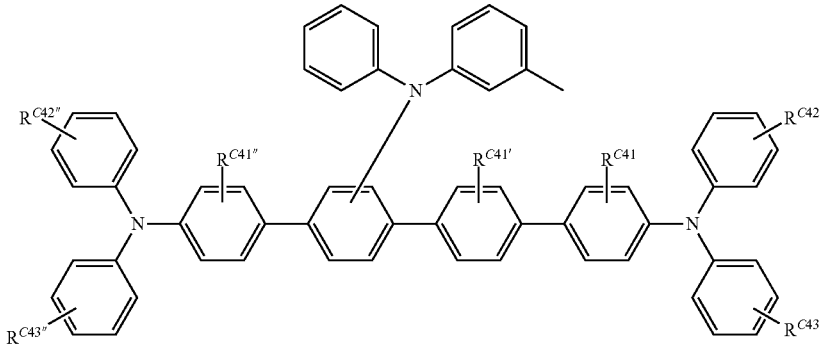

[where $R^{C41}$, $R^{C42}$, $R^{C43}$, $R^{C41'}$, $R^{C41''}$, $R^{C42''}$, and $R^{C43''}$ each independently represent a hydrogen atom, a halogen atom, a hydroxyl group, a formyl group, an alkyl group, an alkoxy group, or an aryl group].

8. A process cartridge comprising the electrophotographic photoreceptor according to claim 1, wherein the process cartridge is removably attached to an image forming apparatus.

9. An image forming apparatus comprising:

the electrophotographic photoreceptor according to claim 1;

a charging unit that serves to charge the surface of the electrophotographic photoreceptor;

an electrostatic latent image forming unit that serves to form an electrostatic latent image on the charged surface of the electrophotographic photoreceptor;

a developing unit that serves to develop the electrostatic latent image on the surface of the electrophotographic photoreceptor with a developer containing toner to form a toner image; and a transfer unit that serves to transfer the toner image to the surface of a recording medium.

* * * * *